US007934276B2

(12) United States Patent
Newkirk et al.

(10) Patent No.: US 7,934,276 B2
(45) Date of Patent: May 3, 2011

(54) END PANEL FOR A PATIENT-SUPPORT APPARATUS

(75) Inventors: David C. Newkirk, Lawrenceburg, IN (US); Kenneth W. Meyer, Batesville, IN (US); John B. Wilker, Jr., Shelbyville, IN (US); Richard H. Heimbrock, Cincinnati, OH (US); James L. Walke, Batesville, IN (US); Robert M. Zerhusen, Cincinnati, OH (US); Michael M. Frondorf, Lakeside Park, KY (US)

(73) Assignee: Hill-Rom Services, Inc., Batesville, IN (US)

( * ) Notice: Subject to any disclaimer, the term of this patent is extended or adjusted under 35 U.S.C. 154(b) by 992 days.

(21) Appl. No.: 11/672,457

(22) Filed: Feb. 7, 2007

(65) Prior Publication Data

US 2007/0180624 A1 Aug. 9, 2007

Related U.S. Application Data

(60) Provisional application No. 60/771,318, filed on Feb. 8, 2006.

(51) Int. Cl.
*A47C 21/08* (2006.01)

(52) U.S. Cl. ..... 5/663; 5/53.1; 5/425; 5/428; 5/429

(58) Field of Classification Search ..... 5/663, 661, 5/53.1, 424–430
See application file for complete search history.

(56) References Cited

U.S. PATENT DOCUMENTS

| | | | | |
|---|---|---|---|---|
| 421,656 | A | 2/1890 | Blanken | |
| 993,119 | A | 5/1911 | Stannard | |
| 1,008,168 | A * | 11/1911 | Markus | 5/184 |
| 1,398,203 | A | 11/1921 | Schmidt | |
| 1,682,394 | A | 8/1928 | Meutsch | |
| 1,885,974 | A | 11/1932 | Winn | |
| 2,136,088 | A | 11/1938 | Stevens | |
| 2,164,484 | A | 7/1939 | Wolfe | |
| 2,254,466 | A | 9/1941 | Albert | |
| 2,281,209 | A | 4/1942 | Smith | |
| 2,452,366 | A | 10/1948 | Freund | |
| 2,556,591 | A | 6/1951 | Loxley | |
| 2,564,083 | A | 8/1951 | Stechert | |
| 2,587,291 | A | 2/1952 | Rochers | |
| 2,605,151 | A | 7/1952 | Shampaine | |
| 2,710,976 | A | 6/1955 | Martensen | |
| 2,722,017 | A | 11/1955 | Burst et al. | |
| 2,766,463 | A | 10/1956 | Bendersky | |
| 2,817,854 | A | 12/1957 | Pratt | |

(Continued)

FOREIGN PATENT DOCUMENTS

DE 19900602 7/2000

(Continued)

OTHER PUBLICATIONS

"Paramount Bed" brochure in Japanese, 60 pages.

(Continued)

*Primary Examiner* — Robert G Santos
(74) *Attorney, Agent, or Firm* — Barnes & Thornburg LLP

(57) ABSTRACT

An end panel 312 for a patient-support apparatus 310 includes a main portion 316 and one or more movable portions 330, 332. The movable portions 330, 332 are movable to provide a barrier 318 in a gap between a siderail 360 of the patient-support apparatus 310 and the main portion 316 of the end panel 312.

25 Claims, 37 Drawing Sheets

U.S. PATENT DOCUMENTS

| | | | | |
|---|---|---|---|---|
| 2,817,855 | A | | 12/1957 | Pratt |
| 2,979,738 | A | | 7/1958 | Goldberg |
| 2,869,614 | A | | 1/1959 | Wamsley |
| 2,951,252 | A | | 9/1960 | Roche |
| 3,010,121 | A | | 11/1961 | Breach |
| 3,018,492 | A | | 1/1962 | Rosen |
| 3,021,534 | A | | 2/1962 | Hausted |
| 3,048,857 | A | | 8/1962 | Hutt |
| 3,053,568 | A | | 9/1962 | Miller |
| 3,055,020 | A | | 9/1962 | Mann |
| 3,097,370 | A | * | 7/1963 | Murcott ..... 5/429 |
| 3,099,440 | A | | 7/1963 | Burzlaff |
| 3,112,500 | A | | 12/1963 | MacDonald |
| 3,138,805 | A | | 6/1964 | Piazza |
| 3,148,387 | A | | 9/1964 | Sarnie et al. |
| 3,195,151 | A | | 7/1965 | Boyer |
| 3,210,779 | A | | 10/1965 | Herbold |
| 3,220,021 | A | | 11/1965 | Nelson |
| 3,220,022 | A | | 11/1965 | Nelson |
| 3,233,255 | A | | 2/1966 | Propst |
| 3,239,853 | A | | 3/1966 | MacDonald |
| 3,249,387 | A | | 5/1966 | Pivacek |
| 3,256,533 | A | | 6/1966 | Michelsen |
| 3,262,133 | A | | 7/1966 | Beitzel |
| 3,266,545 | A | | 8/1966 | Kruissink |
| 3,309,717 | A | | 3/1967 | Black |
| 3,321,779 | A | | 5/1967 | Kaufman et al. |
| 3,344,445 | A | | 10/1967 | Crawford |
| 3,351,962 | A | | 11/1967 | Dodrill et al. |
| 3,406,772 | A | | 10/1968 | Ahrent et al. |
| 3,456,269 | A | | 7/1969 | Goodman |
| 3,486,176 | A | | 12/1969 | Murcott |
| 3,585,659 | A | | 6/1971 | Burst et al. |
| 3,593,350 | A | | 7/1971 | Knight et al. |
| 3,602,929 | A | * | 9/1971 | Murcott et al. ..... 5/429 |
| 3,610,685 | A | | 10/1971 | Lay |
| 3,614,795 | A | | 10/1971 | Agnew |
| 3,619,824 | A | | 11/1971 | Doyle |
| 3,624,847 | A | | 12/1971 | Murcott et al. |
| 3,640,566 | A | | 2/1972 | Hodge |
| 3,735,432 | A | | 5/1973 | Kreten et al. |
| 3,742,530 | A | | 7/1973 | Clark |
| 3,823,428 | A | | 7/1974 | Whyte |
| 3,845,511 | A | | 11/1974 | Benoit et al. |
| 3,851,345 | A | | 12/1974 | Benoit et al. |
| 3,865,434 | A | | 2/1975 | Sully |
| 3,877,090 | A | | 4/1975 | Schutz |
| 3,893,197 | A | | 7/1975 | Ricke |
| 3,897,973 | A | | 8/1975 | Long et al. |
| 3,905,591 | A | | 9/1975 | Schorr et al. |
| 3,916,461 | A | | 11/1975 | Kerstholt |
| 3,932,903 | A | | 1/1976 | Adams et al. |
| 3,971,083 | A | | 7/1976 | Peterson |
| 4,106,138 | A | | 8/1978 | Murphy |
| 4,127,906 | A | | 12/1978 | Zur |
| 4,139,917 | A | | 2/1979 | Fenwick |
| 4,168,099 | A | | 9/1979 | Jacobs et al. |
| 4,183,015 | A | | 1/1980 | Drew et al. |
| 4,186,456 | A | | 2/1980 | Huempfner |
| 4,214,326 | A | | 7/1980 | Spann |
| 4,215,446 | A | | 8/1980 | Mahoney |
| 4,232,415 | A | | 11/1980 | Webber |
| 4,240,169 | A | | 12/1980 | Roos |
| 4,258,445 | A | | 3/1981 | Zur |
| 4,312,500 | A | | 1/1982 | Janssen |
| 4,336,621 | A | | 6/1982 | Schwartz et al. |
| 4,370,765 | A | | 2/1983 | Webber |
| 4,409,695 | A | | 10/1983 | Johnston et al. |
| 4,439,880 | A | | 4/1984 | Koncelik et al. |
| 4,453,732 | A | | 6/1984 | Assanah et al. |
| D276,112 | S | | 10/1984 | Ferrell et al. |
| 4,484,367 | A | | 11/1984 | Jenkins |
| 4,491,993 | A | | 1/1985 | Santo |
| 4,557,471 | A | | 12/1985 | Pazzini |
| 4,607,402 | A | | 8/1986 | Pollard |
| 4,612,679 | A | | 9/1986 | Mitchell |
| 4,653,129 | A | | 3/1987 | Kuck et al. |
| 4,654,903 | A | | 4/1987 | Chubb et al. |
| 4,670,923 | A | | 6/1987 | Gabriel et al. |
| 4,672,698 | A | | 6/1987 | Sands |
| 4,675,926 | A | | 6/1987 | Lirndblom et al. |
| 4,676,687 | A | | 6/1987 | Koffler |
| 4,685,159 | A | | 8/1987 | Oetiker |
| 4,704,750 | A | | 11/1987 | Wheelock |
| 4,710,049 | A | | 12/1987 | Chang |
| 4,710,992 | A | | 12/1987 | Falwell et al. |
| 4,745,647 | A | | 5/1988 | Goodwin |
| 4,747,171 | A | | 5/1988 | Einsele et al. |
| 4,751,754 | A | | 6/1988 | Bailey et al. |
| 4,757,564 | A | | 7/1988 | Goodale |
| 4,767,419 | A | | 8/1988 | Fattore |
| 4,768,249 | A | | 9/1988 | Goodwin |
| 4,783,864 | A | | 11/1988 | Turner |
| 4,799,277 | A | | 1/1989 | Goodale |
| 4,800,600 | A | | 1/1989 | Baum |
| 4,827,545 | A | | 5/1989 | Arp |
| 4,839,933 | A | | 6/1989 | Plewright et al. |
| 4,847,929 | A | | 7/1989 | Pupovic |
| 4,858,260 | A | | 8/1989 | Failor et al. |
| 4,862,529 | A | | 9/1989 | Peck |
| 4,862,530 | A | | 9/1989 | Chen |
| 4,872,228 | A | | 10/1989 | Bishop |
| 4,873,734 | A | | 10/1989 | Pollard |
| 4,894,876 | A | | 1/1990 | Fenwick |
| 4,941,221 | A | | 7/1990 | Kanzler |
| 4,944,055 | A | | 7/1990 | Shainfield |
| 4,974,905 | A | | 12/1990 | Davis |
| 4,985,946 | A | | 1/1991 | Foster et al. |
| 4,991,244 | A | | 2/1991 | Walker |
| 4,993,089 | A | | 2/1991 | Solomon et al. |
| 4,998,310 | A | | 3/1991 | Olson |
| 5,010,611 | A | | 4/1991 | Mallett |
| 5,035,014 | A | | 7/1991 | Blanchard |
| 5,040,253 | A | | 8/1991 | Cheng |
| 5,044,025 | A | | 9/1991 | Hunsinger et al. |
| 5,060,327 | A | | 10/1991 | Celestina et al. |
| 5,072,463 | A | | 12/1991 | Willis |
| 5,077,843 | A | | 1/1992 | Foster et al. |
| 5,083,332 | A | | 1/1992 | Foster et al. |
| 5,083,334 | A | | 1/1992 | Huck et al. |
| 5,084,925 | A | | 2/1992 | Cook |
| 5,097,550 | A | | 3/1992 | Marra, Jr. |
| 5,111,542 | A | | 5/1992 | Farley |
| 5,129,117 | A | | 7/1992 | Celestina et al. |
| 5,175,897 | A | | 1/1993 | Marra, Jr. |
| 5,179,744 | A | | 1/1993 | Foster et al. |
| 5,191,663 | A | | 3/1993 | Holder et al. |
| 5,193,633 | A | | 3/1993 | Ezenwa |
| 5,197,156 | A | | 3/1993 | Stryker et al. |
| 5,205,004 | A | | 4/1993 | Hayes et al. |
| D336,577 | S | | 6/1993 | Celestina et al. |
| 5,216,768 | A | | 6/1993 | Bodine et al. |
| 5,230,113 | A | | 7/1993 | Foster et al. |
| 5,279,010 | A | | 1/1994 | Ferrand et al. |
| 5,365,623 | A | | 11/1994 | Springer |
| 5,381,571 | A | | 1/1995 | Gabhart |
| 5,384,927 | A | | 1/1995 | Mardero et al. |
| 5,408,710 | A | | 4/1995 | Garman et al. |
| 5,410,765 | A | | 5/1995 | Youngblood |
| 5,418,988 | A | | 5/1995 | Iura |
| 5,421,046 | A | | 6/1995 | Vande Streek |
| 5,450,641 | A | | 9/1995 | Montgomery |
| 5,454,126 | A | | 10/1995 | Foster et al. |
| 5,455,973 | A | | 10/1995 | Brumfield et al. |
| 5,479,666 | A | | 1/1996 | Foster et al. |
| 5,481,772 | A | | 1/1996 | Glynn et al. |
| 5,485,699 | A | | 1/1996 | Gabhart |
| 5,524,306 | A | | 6/1996 | George |
| 5,530,974 | A | | 7/1996 | Rains et al. |
| 5,537,699 | A | | 7/1996 | Bonaddio et al. |
| 5,537,701 | A | | 7/1996 | Elliot |
| 5,542,135 | A | | 8/1996 | Ozrovitz et al. |
| 5,557,813 | A | | 9/1996 | Steed et al. |
| 5,557,817 | A | | 9/1996 | Haddock |
| 5,575,025 | A | | 11/1996 | Peters |
| 5,577,277 | A | | 11/1996 | Sundberg et al. |
| 5,577,279 | A | | 11/1996 | Foster et al. |

| | | | |
|---|---|---|---|
| 5,636,397 | A | 6/1997 | Boyd et al. |
| 5,642,545 | A | 7/1997 | Howard |
| 5,642,546 | A | 7/1997 | Shoenhair |
| 5,671,490 | A | 9/1997 | Wu |
| 5,678,267 | A | 10/1997 | Kinder |
| 5,689,839 | A | 11/1997 | Laganiere et al. |
| 5,699,570 | A | 12/1997 | Wilkinson et al. |
| 5,701,623 | A | 12/1997 | May |
| 5,704,085 | A | 1/1998 | Sabalaskey |
| 5,715,548 | A | 2/1998 | Weismiller et al. |
| 5,732,423 | A | 3/1998 | Weismiller et al. |
| 5,745,937 | A | 5/1998 | Weismiller et al. |
| 5,745,939 | A | 5/1998 | Flick et al. |
| 5,749,112 | A | 5/1998 | Metzler |
| 5,761,756 | A | 6/1998 | Nowak et al. |
| 5,771,506 | A | 6/1998 | Joiner et al. |
| 5,781,945 | A | 7/1998 | Scherer et al. |
| 5,787,532 | A | 8/1998 | Langer et al. |
| 5,794,288 | A | 8/1998 | Soltani et al. |
| 5,802,636 | A | 9/1998 | Corbin et al. |
| 5,802,646 | A | 9/1998 | Stolpmann et al. |
| 5,832,549 | A | 11/1998 | Le Pallec et al. |
| 5,864,900 | A | 2/1999 | Landau |
| 5,878,452 | A | 3/1999 | Brooke et al. |
| 5,910,080 | A | 6/1999 | Selton |
| 5,926,873 | A | 7/1999 | Fountain |
| 5,956,787 | A | 9/1999 | James et al. |
| 5,960,497 | A | 10/1999 | Castellino et al. |
| 5,987,666 | A | 11/1999 | Zigmont |
| 6,038,721 | A | 3/2000 | Gordon |
| 6,058,531 | A | 5/2000 | Carroll |
| 6,081,950 | A | 7/2000 | Selton |
| 6,085,372 | A | 7/2000 | James et al. |
| 6,089,593 | A | 7/2000 | Hanson et al. |
| 6,223,369 | B1 | 5/2001 | Maier et al. |
| 6,223,370 | B1 | 5/2001 | Kluft |
| 6,249,924 | B1 | 6/2001 | Kluft |
| 6,256,822 | B1 | 7/2001 | Weston et al. |
| 6,289,539 | B1 | 9/2001 | Alpern |
| 6,347,422 | B2 | 2/2002 | Heavrin |
| 6,363,552 | B1 | 4/2002 | Hornbach et al. |
| 6,374,440 | B1 | 4/2002 | Thim, Jr. |
| 6,397,416 | B2 | 6/2002 | Brooke et al. |
| 6,401,277 | B1 | 6/2002 | Savage et al. |
| 6,401,281 | B1 | 6/2002 | Younge |
| 6,427,264 | B1 | 8/2002 | Metz et al. |
| 6,430,766 | B1 | 8/2002 | Henley et al. |
| 6,615,426 | B1 | 9/2003 | Risk, Jr. |
| 6,622,323 | B2 * | 9/2003 | Zerhusen et al. ..... 5/427 |
| 6,629,326 | B2 | 10/2003 | Rabe |
| 6,640,360 | B2 * | 11/2003 | Hornbach et al. ..... 5/425 |
| 6,668,399 | B2 | 12/2003 | Malstaff et al. |
| 6,704,954 | B2 * | 3/2004 | Metz et al. ..... 5/425 |
| 6,721,975 | B1 | 4/2004 | Lemine |
| 6,874,179 | B2 * | 4/2005 | Hensley et al. ..... 5/425 |
| 7,007,323 | B2 * | 3/2006 | Zerhusen et al. ..... 5/427 |
| 7,107,636 | B2 | 9/2006 | Metz et al. |
| 7,237,284 | B2 * | 7/2007 | Hensley et al. ..... 5/425 |
| 7,350,248 | B2 * | 4/2008 | Hensley et al. ..... 5/430 |
| 2001/0044970 | A1 | 11/2001 | Heavrin |
| 2001/0054199 | A1 * | 12/2001 | Zerhusen et al. ..... 5/428 |
| 2002/0095724 | A1 * | 7/2002 | Hornbach et al. ..... 5/425 |
| 2002/0170113 | A1 | 11/2002 | Metz et al. |
| 2004/0000010 | A1 * | 1/2004 | Zerhusen et al. ..... 5/428 |
| 2007/0180624 | A1 * | 8/2007 | Newkirk et al. ..... 5/663 |
| 2009/0229050 | A1 * | 9/2009 | Heimbrock ..... 5/430 |

FOREIGN PATENT DOCUMENTS

| | | |
|---|---|---|
| EP | 0037063 | 10/1981 |
| FR | 1450817 | 8/1966 |
| FR | 2680955 | 3/1993 |
| GB | 1466080 | 3/1977 |
| GB | 2163951 | 3/1986 |
| GB | 2229907 | 10/1990 |
| GB | 2267430 | 8/1993 |
| GB | 2284147 | 5/1995 |
| GB | 2313303 | 11/1997 |
| NL | 8300814 | 10/1984 |
| WO | 8101792 | 7/1981 |
| WO | 9817153 | 4/1998 |
| WO | 9915126 | 9/2008 |

OTHER PUBLICATIONS

Catalog "A Hill-Rom Solution: Med-Surg Bed Accessories", Hill-Rom, 1997, six pages.

Supplementary European Search Report from EP 07 76 3571 dated Jan. 26, 2010.

* cited by examiner

END PANEL FOR A PATIENT-SUPPORT APPARATUS

This application claims priority under 35 U.S.C. §119(e) to U.S. Provisional Application Ser. No. 60/771,318, filed Feb. 8, 2006, which is expressly incorporated by reference herein.

BACKGROUND OF THE INVENTION

The present disclosure relates to bed ends for patient-support apparatuses. More specifically, the present disclosure relates to bed ends having members which are movable between a stowed position and a use position filling a gap between a siderail and the end panel of the patient-support apparatus.

SUMMARY OF THE INVENTION

The present disclosure comprises one or more of the features recited in the appended claims and/or the following features which, alone or in any combination, may comprise patentable subject matter:

A patient-support apparatus such as a hospital bed comprises an end panel comprising a main portion configured to engage a frame of the patient-support apparatus to form a boundary structure. The main portion comprises a generally vertical surface having a curvilinear profile when viewed along a generally vertical axis and a generally horizontal slot formed in the generally vertical surface. The end panel further comprises an extender movable relative to the main portion to increase the size of the boundary structure. The extender comprises a generally vertical surface parallel to the generally vertical surface of the main portion. The extender further comprises a guide engaged with the slot to support the extender relative to the main portion for movement relative thereto.

Movement of the extender relative to the main portion forms a boundary adjacent a longitudinal side of a mattress supported on the patient-support apparatus. In some embodiments, the extender comprises a first portion movable relative to the main portion and a second portion which is engaged with the first portion and extendable relative thereto. The first portion may comprise a first panel and a second panel. The first and second panels may include tracks. The second portion may be received between the panels and include guides received in the tracks to guide movement of the second portion relative to the first portion. In some embodiments, the extender may comprise a generally planar flange configured to extend between a frame of the patient-support apparatus and a mattress supported on the patient-support apparatus.

The patient-support apparatus may further comprise a frame including a first patient-support section and a second patient-support section movable relative to the first patient-support section to vary a size of a patient-support surface. The first portion of the extender may comprise an engagement pin and the first patient-support section may comprise a coupler configured to receive the engagement pin to couple the first portion of the extender to the first patient-support section. The patient-support apparatus may further comprise a siderail spaced apart from the end panel and a bracket releasably coupled to the siderail. The bracket may include a clamp configured to receive the second portion of the extender to position the extender to occupy a gap between the siderail and the main portion of the end panel. In some embodiments, the clamp may be spring biased. The bracket may include an actuator actuable to overcome the spring bias to release the clamp.

In some embodiments, the coupler may include a slide movable between a closed position and an open position. The slide may be spring biased to the closed position.

In another embodiment, an end panel comprises a first portion configured to engage a portion of a patient-support apparatus to form a barrier and a second portion coupled to the first portion and movable relative thereto. The second portion may be movable between a first position adjacent the first portion and a second position wherein the second portion is positioned adjacent a patient-support surface. The second portion may extend vertically above the patient-support surface to form a barrier. The end panel may further comprise a detent assembly configured to maintain the second portion in the second position.

In some embodiments, the second portion may pivot relative to the first portion about a generally vertical axis. The detent assembly may comprise a receiver coupled to the first portion and a generally vertical pivot shaft defining a pivot axis coupled to the second portion. The pivot shaft may include a cross-member configured to engage the receiver when the second portion is in the second position. The second portion may be movable along the pivot axis to disengage the cross-member from the receiver to release the second portion.

In some embodiments, the detent assembly may comprise a first plate comprising a tab, the first plate coupled to the first portion and a second plate comprising at least one slot configured to engage the tab when the second portion is in the second position. The second portion may be movable along the pivot axis to disengage the slot from the tab to release the second portion.

In some embodiments, the second portion may translate relative to the first portion. For example, the first portion may comprise a track and a slider engaged with the track. The slider may be slidable along the track and include a pivot support configured to support the second portion for pivotable movement relative thereto. In some embodiments, the second portion may be pivotable about a generally horizontal axis between a vertical configuration and a horizontal configuration.

In still other embodiments, an end panel may comprise a main portion configured to mount to the frame of a patient-support apparatus and an extender coupled to the main portion and configured to be coupled to a siderail of the patient-support apparatus to enclose a gap between the main portion and a siderail of the patient-support apparatus. The extender may be spring retractable. The extender may extend and retract with movement of the second patient-support section. The extender may comprise a fabric web coupled to a spring retractor, the spring retractor biased to retract the fabric. The extender may comprise a plurality of fabric webs, each fabric web coupled to a separate spring retractor, the spring retractors biased to retract the fabric. In some embodiments, the extender further comprises a grip configured to couple to the siderail, wherein each web is coupled to the grip.

Additional features, which alone or in combination with any other feature(s), including those listed above and those listed in the claims, may comprise patentable subject matter and will become apparent to those skilled in the art upon consideration of the following detailed description of illustrative embodiments exemplifying the best mode of carrying out the invention as presently perceived.

BRIEF DESCRIPTION OF THE DRAWINGS

The detailed description particularly refers to the accompanying figures in which:

FIG. 31 showing another embodiment of an end panel having a extender, the extender of FIG. 31 having an adjustment mechanism positioned at the end opposite the vertical pivot axis of the moving portion;

DETAILED DESCRIPTION OF THE DRAWINGS

Figure 1:
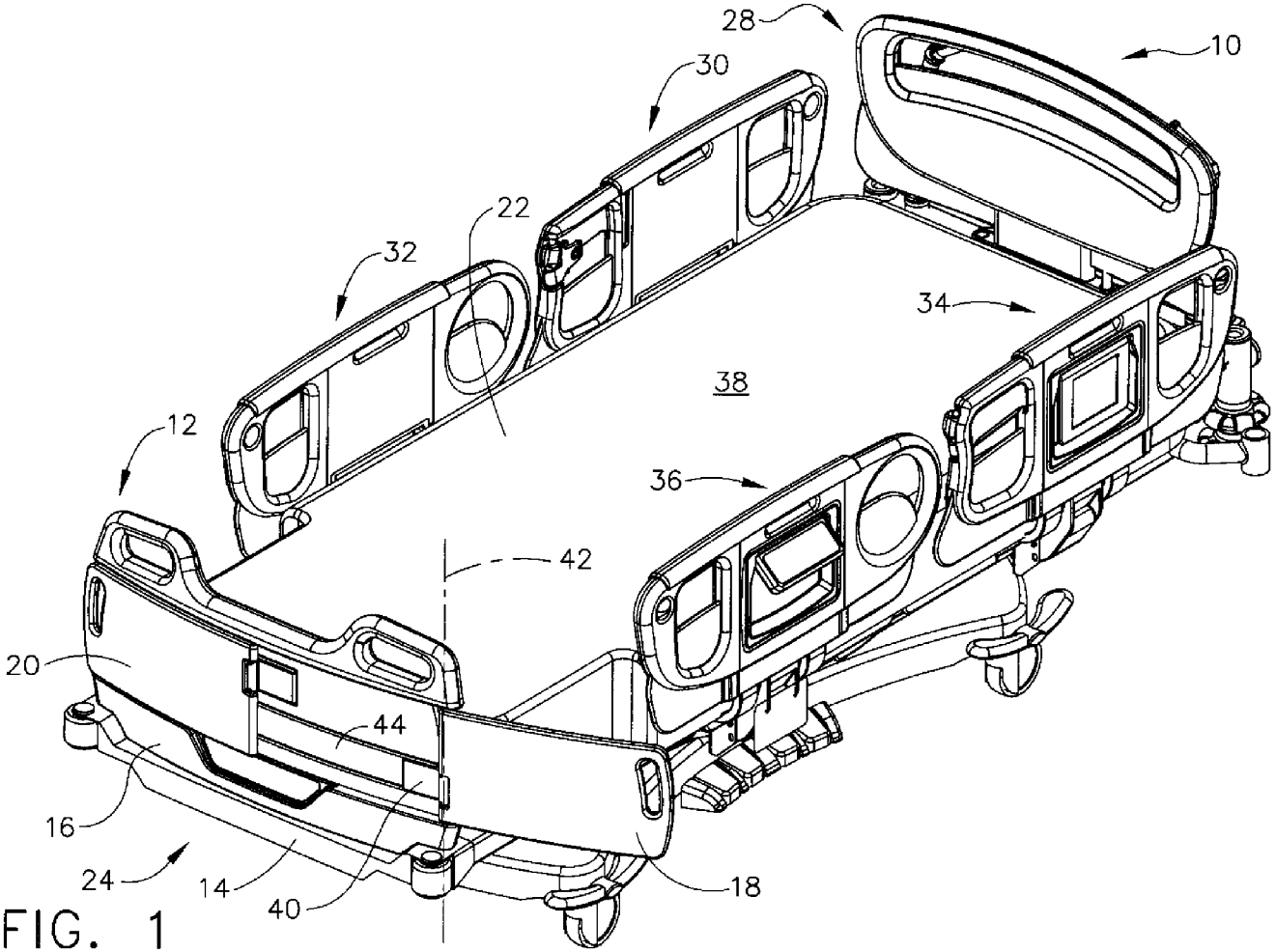
FIG. 1 is a perspective view of a patient-support apparatus including an embodiment of a footboard according to the present disclosure, the footboard having a siderail portion pivotable about a vertical axis from a stowed position to a use position, the siderail portion of the footboard extending laterally outwardly from the end panel.
Figure 2:
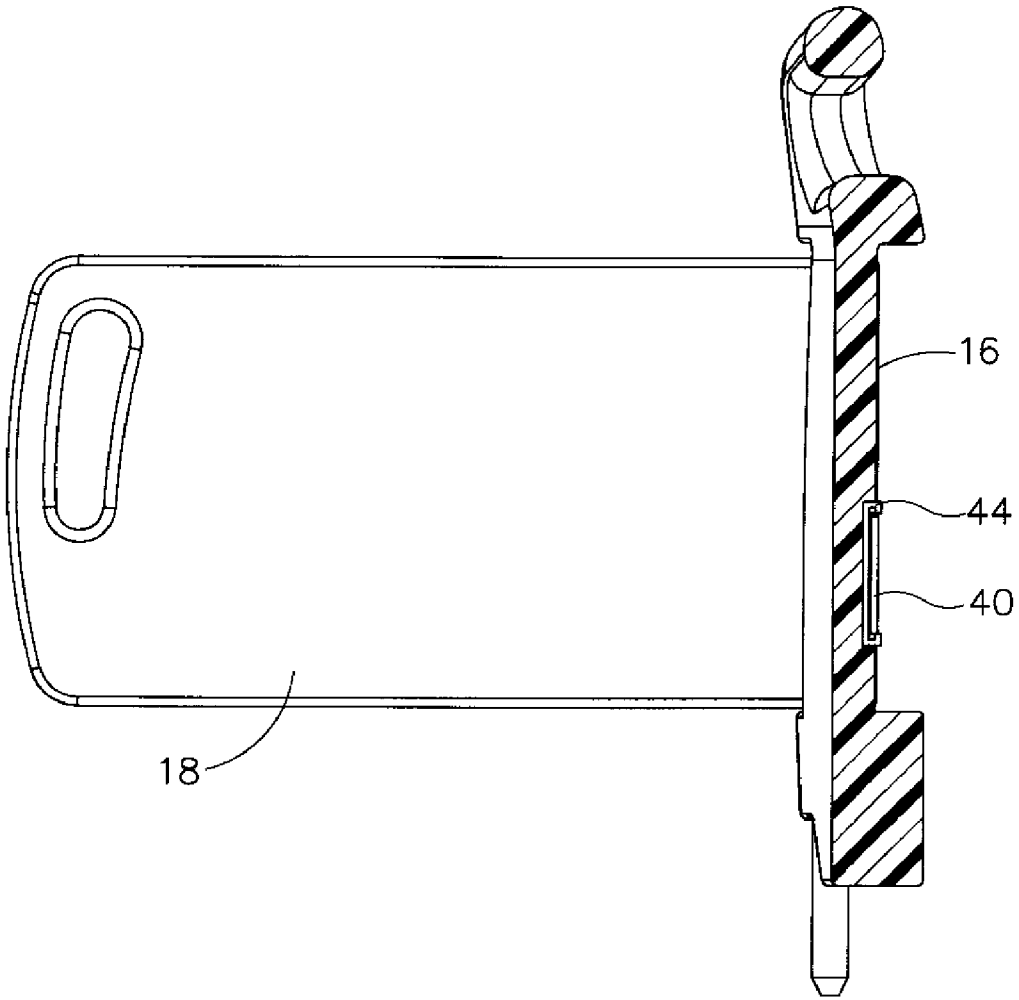
FIG. 2 is a view of the embodiment of the end panel of FIG. 1 with a siderail portion in a use position and a body of the footboard shown in cross-section.

In one illustrative embodiment of the present disclosure, an end panel 12 is mounted on a foot deck 14 of a patient-support apparatus 10, the end panel 12 including a body 16, a first extender 18, and a second extender 20 as shown in FIG. 1. Illustratively, patient-support apparatus 10 is embodied as a hospital bed. Hospital bed 10 is shown in FIG. 1 with a foot end 24 positioned at the lower left side of the figure and a head end 26 at the upper right side of the figure. Typically, a patient occupies the hospital bed 10 in a supine position on a patient-support surface 22.

When referring to locations on the hospital bed 10, the terms "head end" and "foot end" are used generally to provide orientation and do not refer to specific features of the hospital bed 10. The terms "patient left" and "patient right" are used to provide orientation relative to a patient positioned on the hospital bed 10 lying in a supine position. As shown in FIG. 1, end panel 12 is oriented at the foot end 24 and an end panel 28 is oriented at a head end 26. Hospital bed 10 further includes four siderails: a right head rail 30, a right foot rail 32, a left head rail 34, and a left foot rail 36. Siderails 30, 32, 34 and 36 are movable between a barrier position as shown in FIG. 1 and a lowered position wherein the siderails 30, 32, 34 and 36 are below a top surface 38 of patient-support surface 22.

Figure 3:
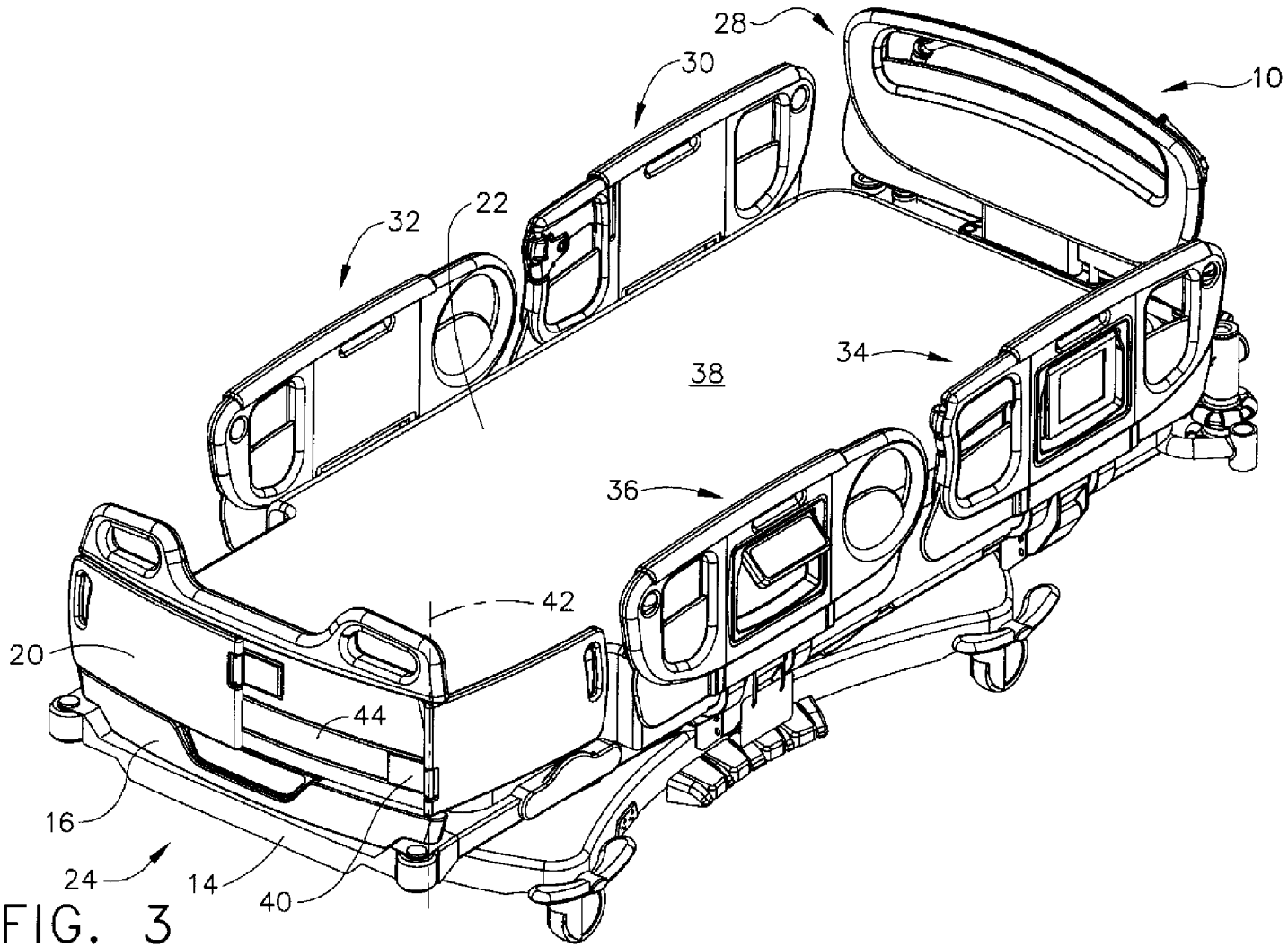
FIG. 3 is a perspective view of the patient-support apparatus of FIG. 1 with the siderail portion of the end panel in a use position.

The extenders 18 and 20 of end panel 12 are movable relative to the body 16 to a position wherein the extender is positioned adjacent the patient-support surface 22 and extending above top surface 38 of patient-support surface 22 to form a barrier between the end panel 12 and siderail 24 as suggested in FIG. 3. The remaining discussion of the illustrative embodiment of FIG. 1 will address the operation of extender 18 relative to body 16. It should be understood that the operation of extender 20 is similar to the operation of extender 18 with extender 20 positioned to form a barrier between body 16 and right foot siderail 32.

When in a position as suggested in FIG. 3, a extender 18 prevents the feet and legs of a patient-supported on patient-surface 22 from slipping off of an edge of the patient-support surface 22. Movement of extender 18 between a stowed position (see, for example, the position of extender 20 in FIG. 1) and a use position (such as the position of extender 18 in FIG. 3) is facilitated by a slider 40 which supports extender 18 such that extender 18 is pivotable relative to slider 40 about an axis 42. Slider 40 moves along a track 44 coupled to body 16 of end panel 12. When slider 40 is positioned at an outboard position along track 44, there is sufficient clearance between extender 18 and body 16 to permit extender 18 to pivot about axis 42.

Figure 35:
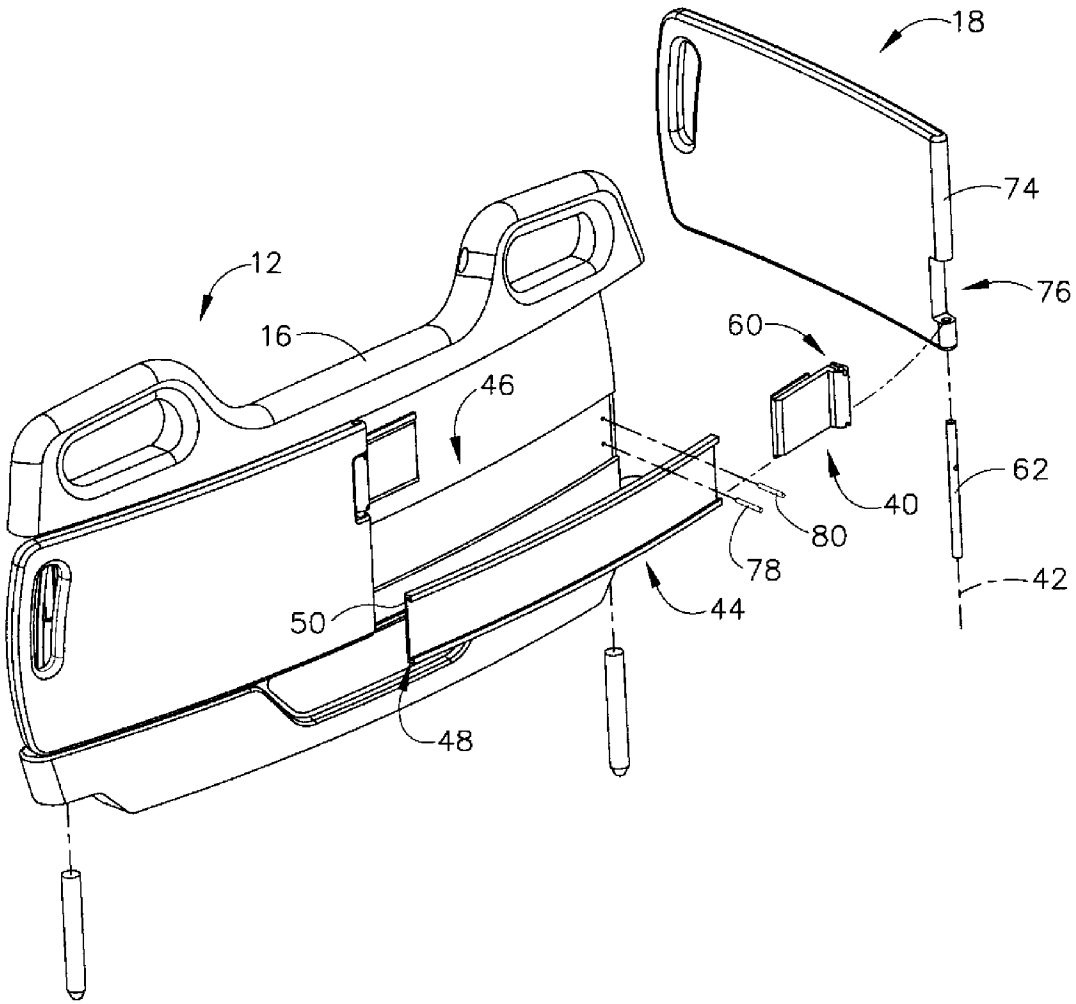
FIG. 35 is a partially exploded assembly view of the end panel of FIG. 1.

Referring now to FIG. 35, an exploded assembly view of end panel 16 shows that track 44 is received in a indentation 46 in end panel 16 and slider 40 is received in track 44. Track 44 includes two channels 48 and 50 which are configured to receive two flanges 52 and 54 of slider 40. The flanges 52 and 54 are coupled to a body 56 of slider 44. A pivot support 58 is also coupled to body 56 and includes a through-hole 60 configured to receive a support shaft 62 therethrough. Support shaft 62 is an elongated cylindrical shaft with a centerline which defines the pivot axis 42.

Pivot support 58 includes a channel 64 formed in an upper surface 66. Channel 64 is perpendicular to and intersects through-hole 60. Pivot shaft 62 includes a through-hole 68 which has an axis 70 generally perpendicular to the longitudinal axis 42. Through-hole 68 is sized to receive a pin 72 therethrough. Pin 72 is an elongate cylindrical member with a diameter which is sized to be received in channel 64 when the pin 72 is aligned with channel 64.

A rectangular portion of extender 18 is cut away along a side 74 to form a receiver 76 which is sized to receive the pivot support 58 of slider 44 with clearance between pivot support 58 and the extender 18. When extender 18 is coupled to slider 40, pivot shaft 62 is secured to extender 18 and moves with extender 18. The clearance between the extender 18 and pivot support 58 within receiver 76 allows extender 18 to be raised in the direction parallel to axis 42 such that pivot shaft 62 moves relative to pivot support 58 to allow pin 72 to clear channel 64. Once pin 72 clears channel 64, extender 18 is free to pivot relative to slide 40. Barrier 18 is supported on pin 72 which is supported on surface 66 of pivot support 58 when extender is not in the position shown in FIG. 3. Pivot shaft 62, pin 72, and channel 64 of pivot support 58 cooperate as a detent assembly for positioning and holding the extender 18 in the use position shown in FIG. 3 until the extender is released by lifting the extender 18 to disengage pin 72 from channel 64.

Figure 36:
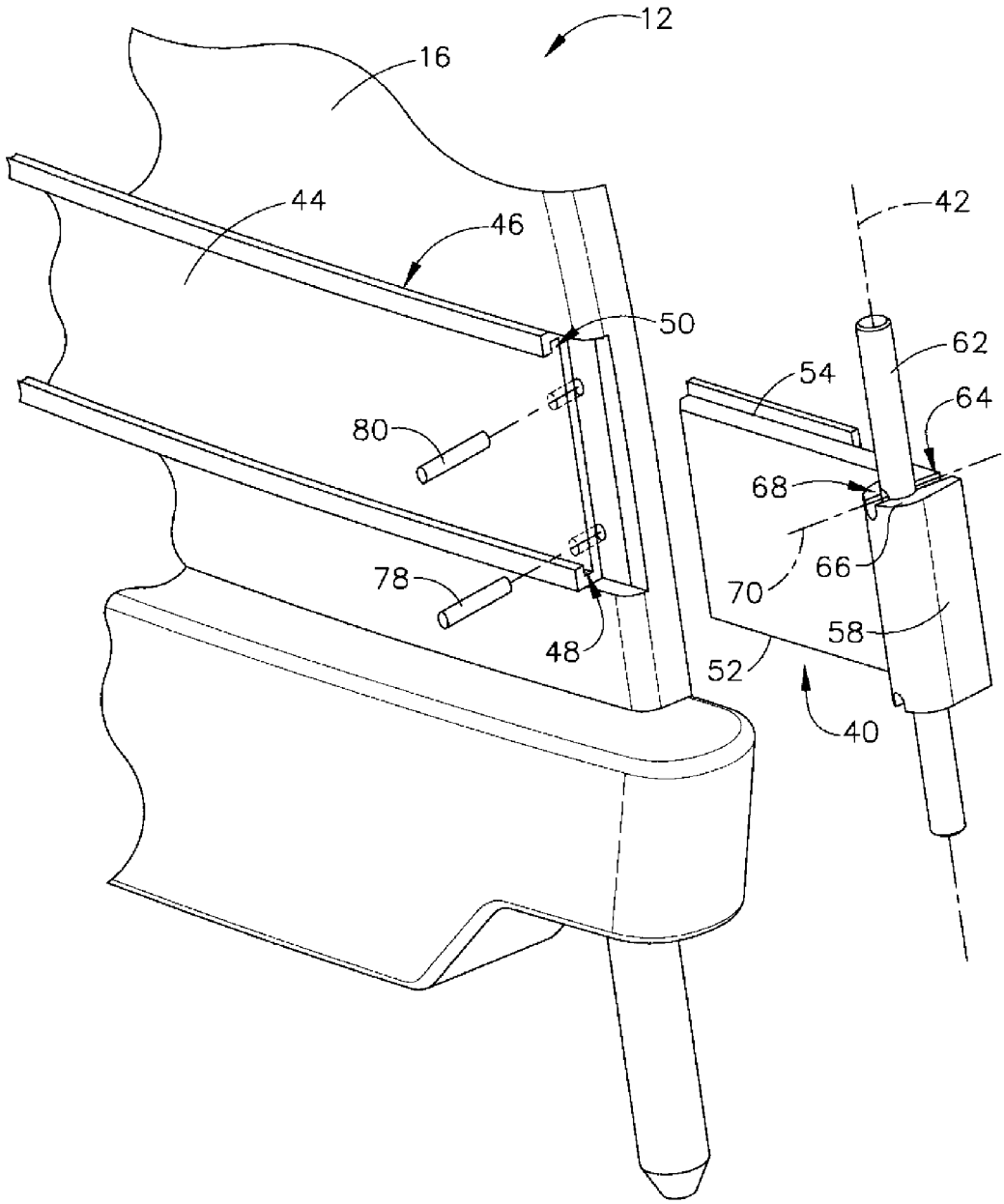
FIG. 36 is an exploded assembly view of a portion of the end panel of FIG. 1.
Figure 37:
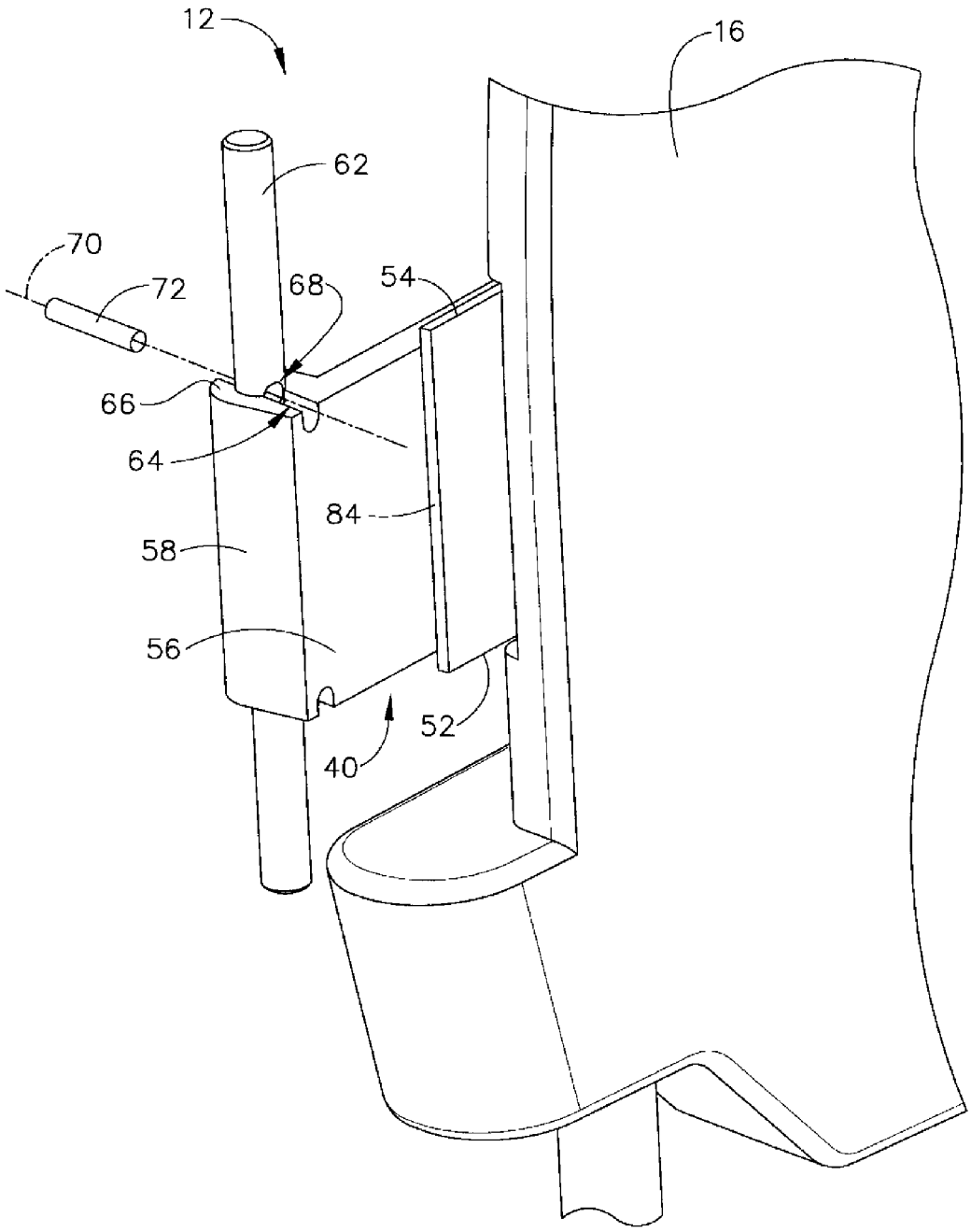
FIG. 37 is a perspective view a portion of the end panel of FIG. 1 showing the engagement of a slider with a track.
Figure 38:
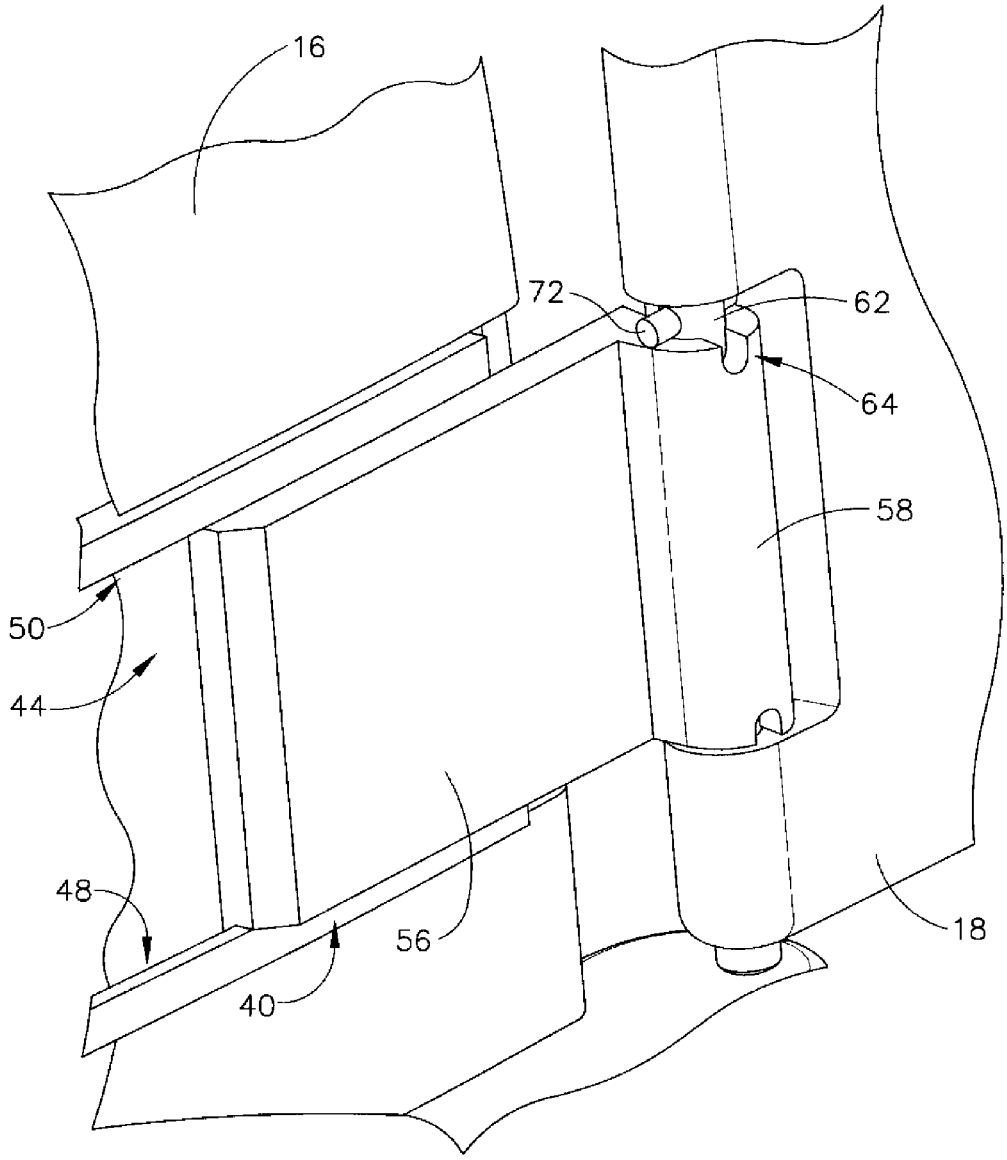
FIG. 38 is a perspective view of a detent assembly of the end panel of FIG. 1.
Figure 39:
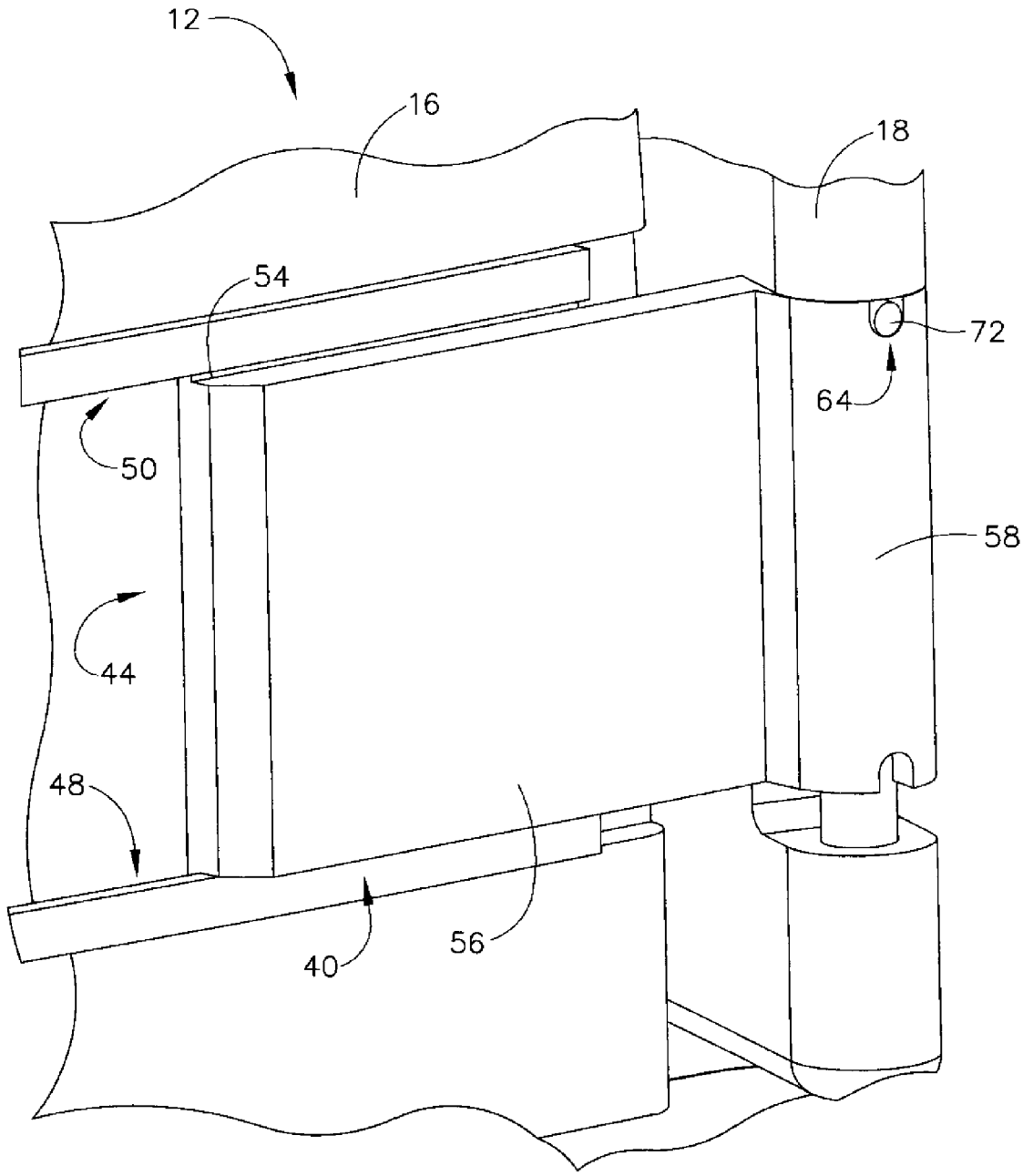
FIG. 39 is a view similar to the view of FIG. 38 with the detent mechanism engaged.

Slide 40 is retained within track 44 by two pins 78 and 80 which are coupled to body 16 within indentation 46 as shown in FIG. 36. Pins 78 and 80 extend from a surface 82 of indentation 46 to engage a surface 84 (best seen in FIG. 37) of slide 40. Referring now to FIG. 39, when extender 18 is positioned such that pin 72 is received in channel 64, extender 18 engages an end surface 86 of body 16 and surface 84 of slide 40 engages pins 78 and 80 which limits movement of slide 40 relative to track 44.

Figure 4:
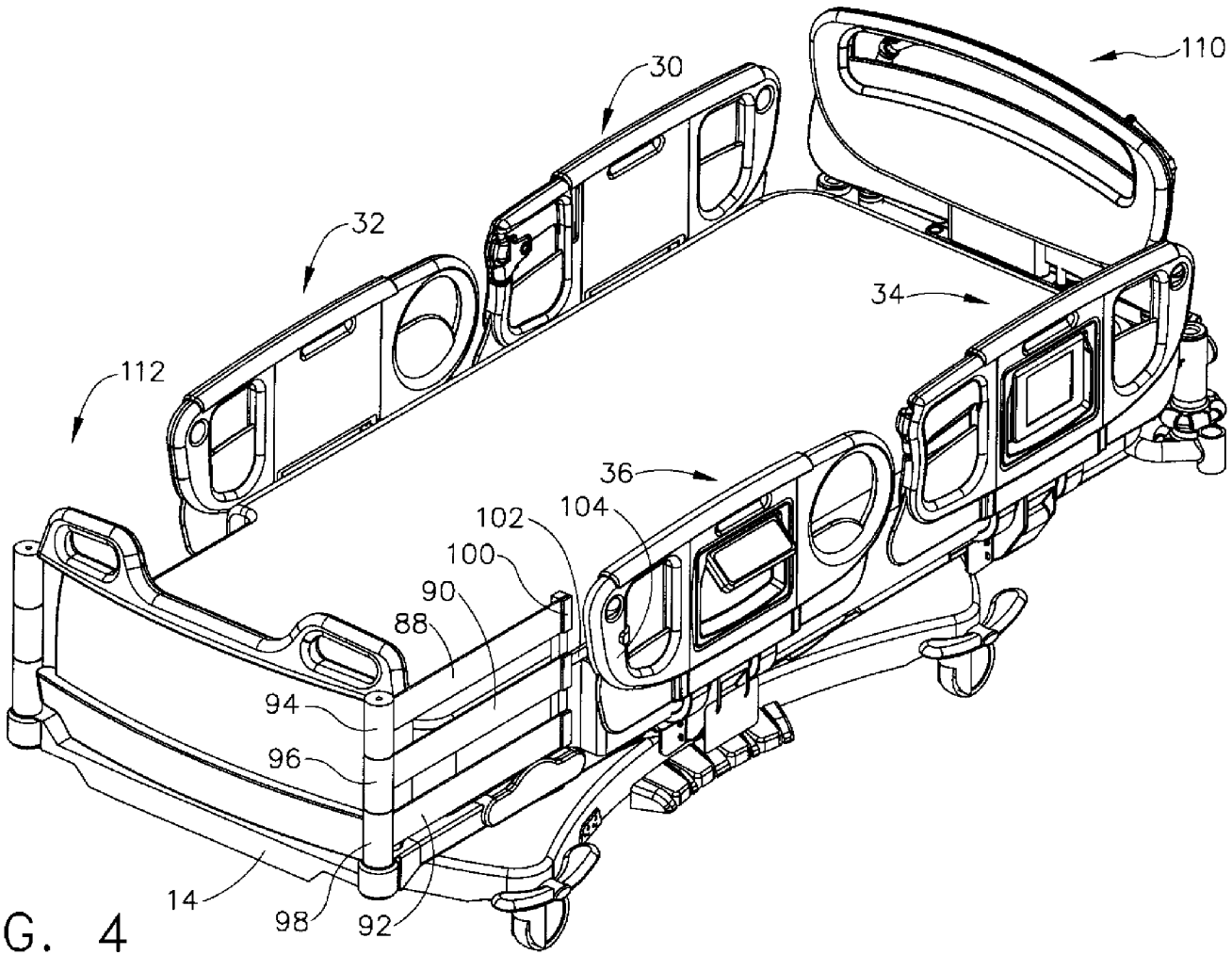
FIG. 4 is a perspective view of a patient-support apparatus similar to the patient-support apparatus of FIG. 1, the patient-support of FIG. 4 including another embodiment of an end panel, the end panel including a plurality of retractable webs and a coupler configured to engage a siderail of the patient-support apparatus such that the webs extend from the end panel to the siderail to form a barrier therebetween.
Figure 5:
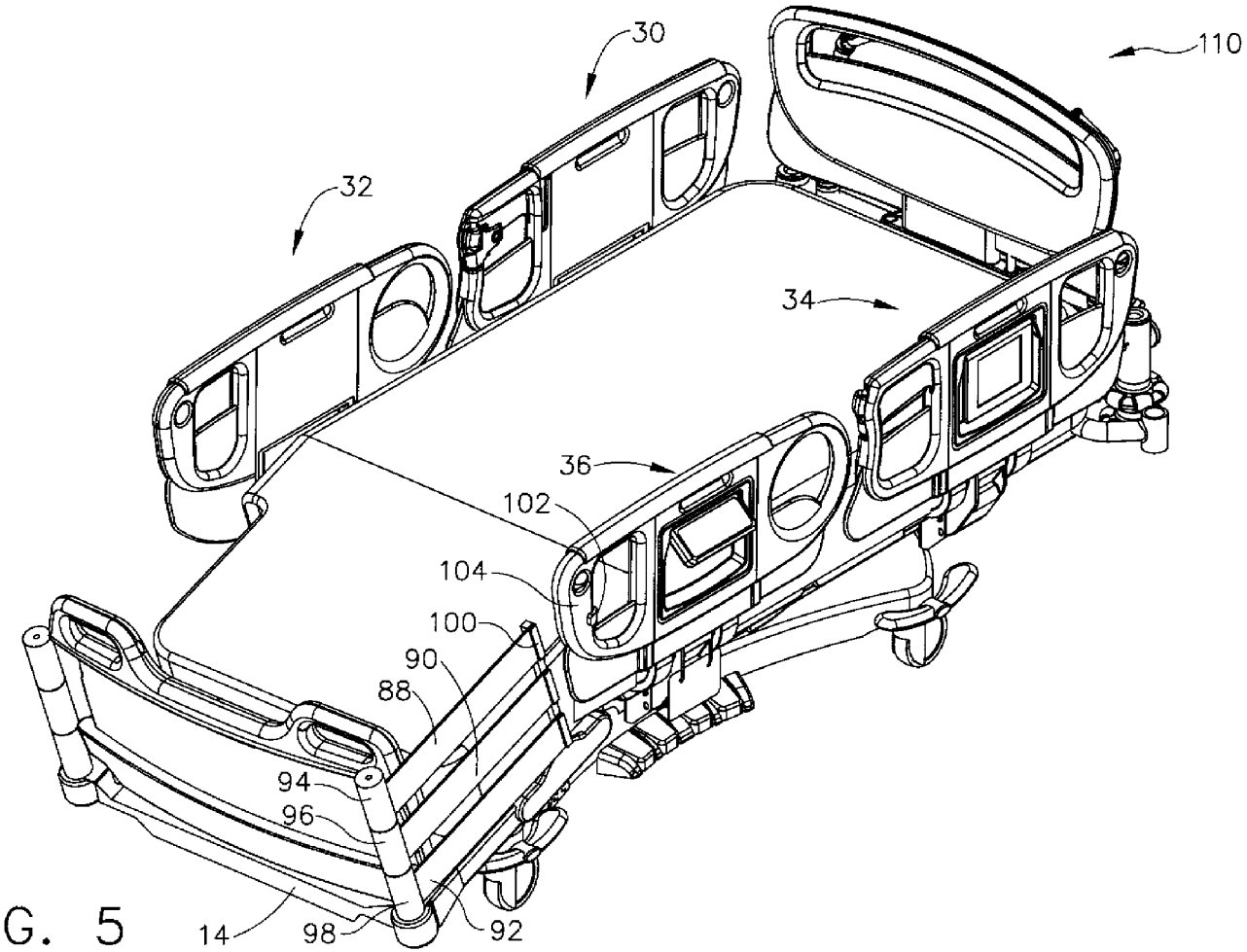
FIG. 5 is a perspective view of the patient-support apparatus of FIG. 4 with a foot section of the patient-support apparatus articulated downwardly from a horizontal position, the webs of the end panel extending during articulation of the foot section.

In another embodiment of a patient-support apparatus 110, an end panel 112 positioned on frame 14 includes three webs 88, 90 and 92 which extend from three spring retractors 94, 96, and 98 respectively as shown in FIGS. 4 and 5. The webs 88, 90 and 92 each couple to a frame 100. Frame 100 is coupled to a hook 102 which is configured to engage an upright 104 of siderail 36. Webs 88, 90 and 92 cooperate to form a barrier extending from a body 106 of end panel 112 to siderail 36 to provide boundary in the gap therebetween. Spring retractors 94, 96, and 98 allow webs 88, 90, and 92 to extend and retract as the size of the gap changes due to articulation of portions of the patient-support apparatus 10. For example, frame 14 of patient-support apparatus 110 is extensible to change in length relative to other frames of the patient-support apparatus. As the length of frame 14 is changed, the distance between siderail 36 and end panel 112 changes. Webs 88, 90, and 92 lengthen or retract with the changes in the length of frame 14. Also, frame 14 is articulable between the position shown in FIG. 4 and a lowered position as suggested in FIG. 5. To the extent that web 88 lengthens and web 92 shortens during this articulation, retractors 94 and 98 adjust the length of the webs 88 and 92 to react to those changes.

Figure 7:
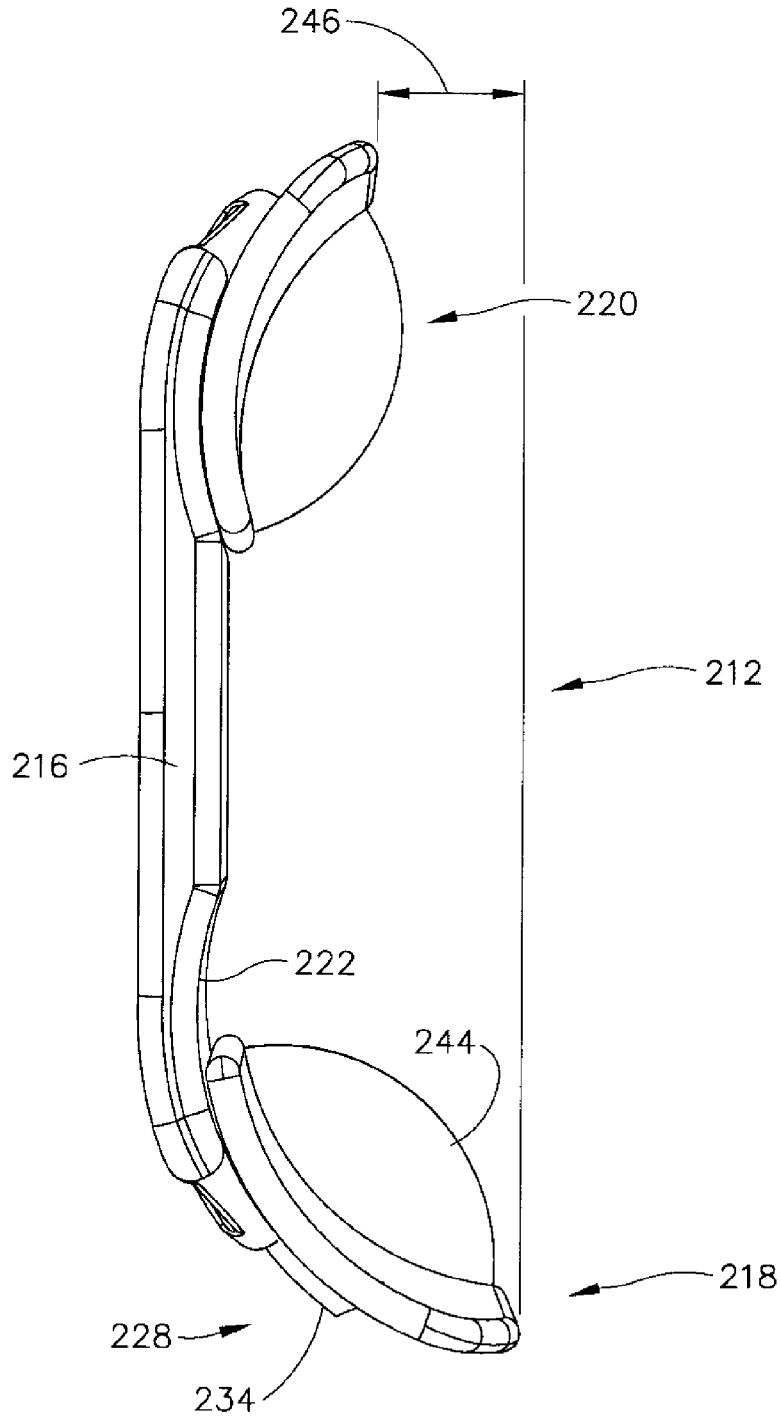
FIG. 7 is a top view of the end panel of FIG. 6 with the extender at the bottom of the page extended from the body to form a barrier.
Figure 8:
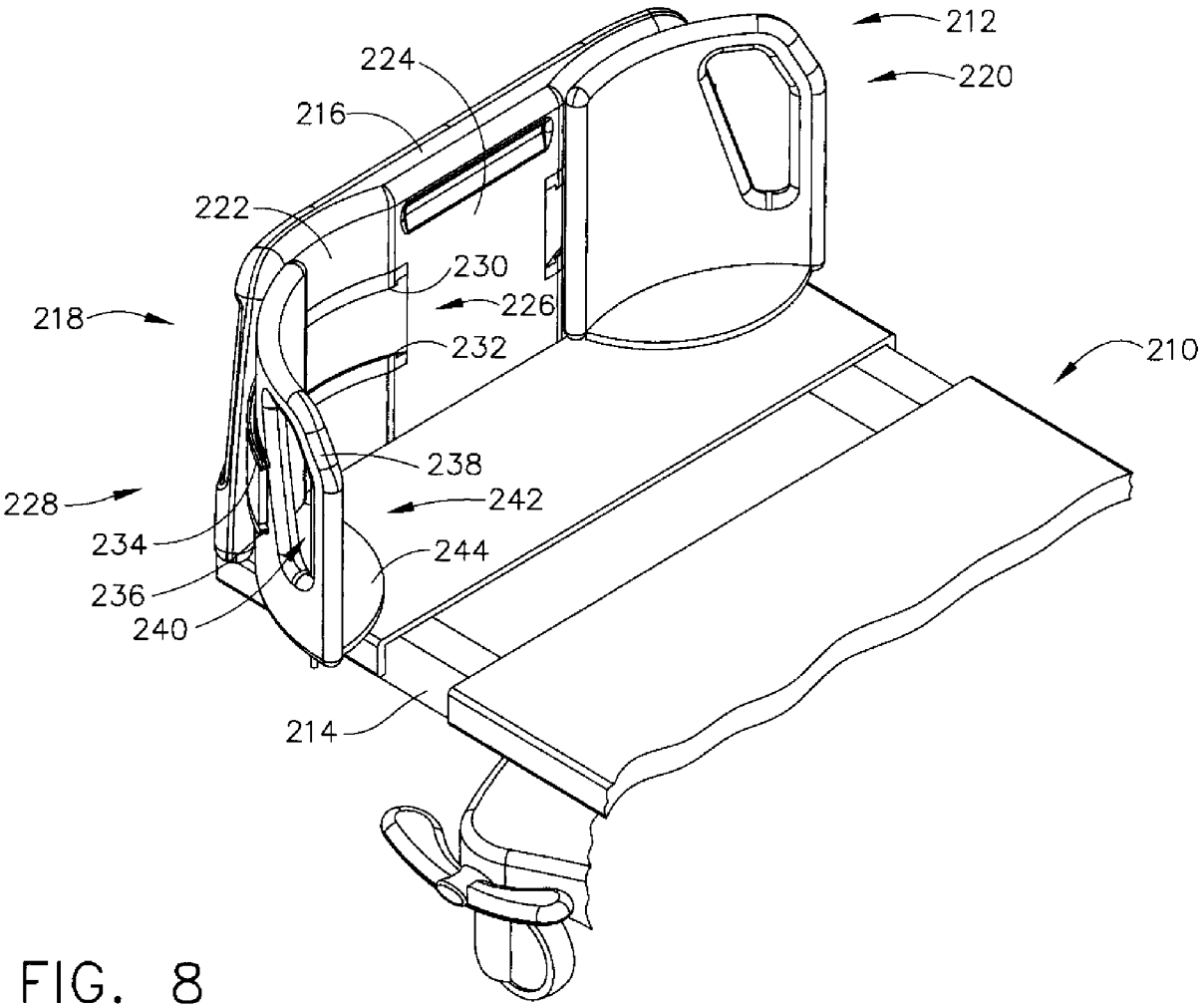
FIG. 8 is a perspective view of a portion of a patient-support apparatus with the end panel of FIGS. 6 and 7 positioned on the patient-support apparatus, a extender on the left side of the figure in an extended position.

Another embodiment of a patient-support apparatus 210 includes an end panel 212 having a body 216 mounted on a frame 214 of the patient-support apparatus 210 as shown in FIG. 8. FIG. 8 shows the end panel 212 mounted at a foot end of patient-support apparatus 210. End panel 212 further includes a left extender 218 and a right extender 220. In FIGS. 7 and 8, left extender 218 is shown in an extended position wherein left extender 218 has been extended from body 216 to form a barrier along a left portion of the patient-support apparatus 210 to reduce the potential of a foot of a patient-supported on the patient-support apparatus 210 from slipping off from a mattress (not shown) on the patient-support apparatus 210. Illustratively, patient-support apparatus 210 has an extendable frame 214. Extenders 218 and 220 are movable to reduce the size of the gap between the end panel 212 and foot end siderails (not shown) of the patient-support apparatus 210.

In the illustrative embodiment of FIGS. 7 and 8, the extenders 218 and 220 are manually movable from a stowed position (e.g. extender 220) to an extended position (e.g. extender 218). Extenders 218 and 220 are engaged with body 216 and slidable relative thereto. The discussion of the structure of end panel 212 and the engagement and movement of extender 218 relative to body 216 is applicable to extender 220 except that extender 220 is positioned and configured to function on the right side of the patient-support apparatus 210.

Body 216 includes a contoured surface 222 which intersects a generally planar vertical surface 224 positioned to face the head end of the patient-support apparatus 210. A slot 226 configured to receive a track 228 coupled to extender 218 such that slot 226 guides the movement of extender 218 relative to body 216. Slot 226 has a t-shaped cross-section with an upper flange 230 and a lower flange 232. Track 228 has a u-shaped upper guide 234 and a u-shaped lower guide 236 which engage with flanges 230 and 232 respectively. Engagement of flanges 230 and 232 with guides 234 and 236 supports extender 218 for movement relative to body 216. Body 216 includes a stop (not shown) which engages a flange (not shown) coupled to track 228 to limit the movement of extender 218 relative to body 216.

Extender 218 has a contoured shape which is complementary to the contour of surface 222 such that extender 218 maintains a generally constant relative spacing with respect to body 216 during movement of extender 218. Extender 218 further includes a handle 242 which is includes a grip 238 and an aperture 240 through extender 218. Handle 242 is configured to be used by a user, such as a caregiver, for example, to be gripped to move extender 218 relative to body 216. Guides 234 and 236 a configured to have sufficient clearance such that extender 218 moves with minimal resistance.

Extender 218 further comprises a generally planar flange 244 which extends away from end panel 212 generally toward the head end of patient-support apparatus 210. Flange 244 is configured to extend beneath a mattress supported on patient-support apparatus 210 to prevent linens on the mattress from becoming entangled with the movement of extender 218. Referring to FIG. 7, the increase in coverage of extender 218 is depicted by the distance 246 which represents the change in length of extender 218 in the extended position as compared to extender 220 which is depicted in a retracted position in FIGS. 7 and 8.

Figure 6:
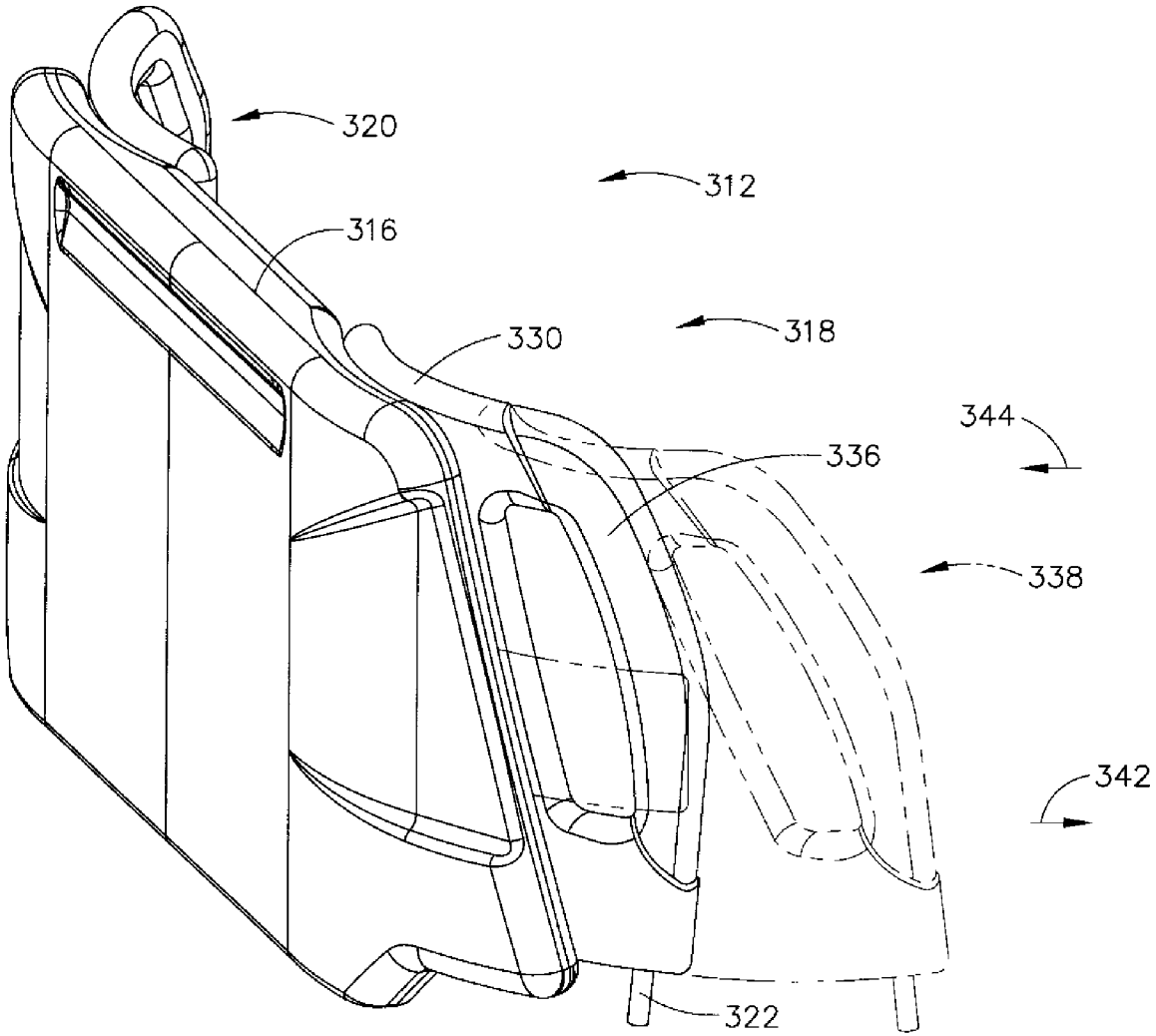
FIG. 6 is a perspective view of another embodiment of an end panel for a patient-support apparatus, the end panel including a body and two extenders, the extenders movable relative to the body to form a siderail as shown in phantom.

In another embodiment of end panel 312 shown in FIG. 6, a extender 318 engages with a body 316 in a manner similar to the illustrative embodiment of FIGS. 7 and 8. End panel 312 further includes an engagement pin 322 coupled to a lower portion of extender 318. Engagement pin 322 is configured to be received by a coupler 324 secured on a frame 314 of a patient-support apparatus 310 shown in FIGS. 10-12. End panel 312 is supported on a moving portion 326 of frame 314 and coupler 324 is secured to a fixed portion 328. When frame 314 is extended, the movement of moving portion 326 relative to fixed portion 328 causes relative movement of extender 318 relative to body 316 of end panel 312. Thus, extender 318 extends to form a boundary in the space created between a siderail 36 and end panel 312. Having extender 318 secured to fixed portion 328 eliminates the need for a caregiver to manually extend the extender 318 when the length of frame 314 is increased.

Figure 10:
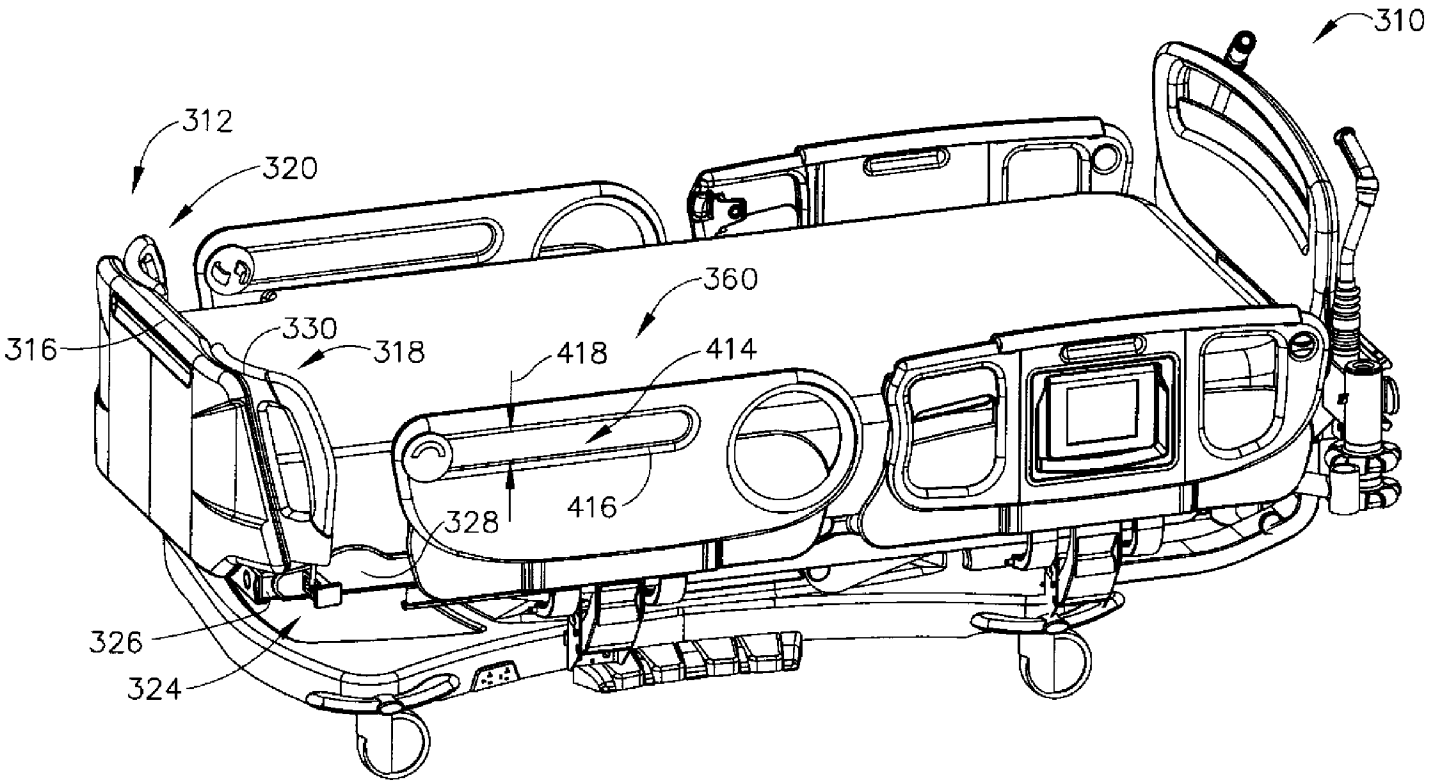
FIG. 10 is a perspective view of a patient-support apparatus including the end panel of FIG. 9 mounted on the patient support apparatus, the first and second extenders of the end panel in their respective retracted positions.
Figure 11:
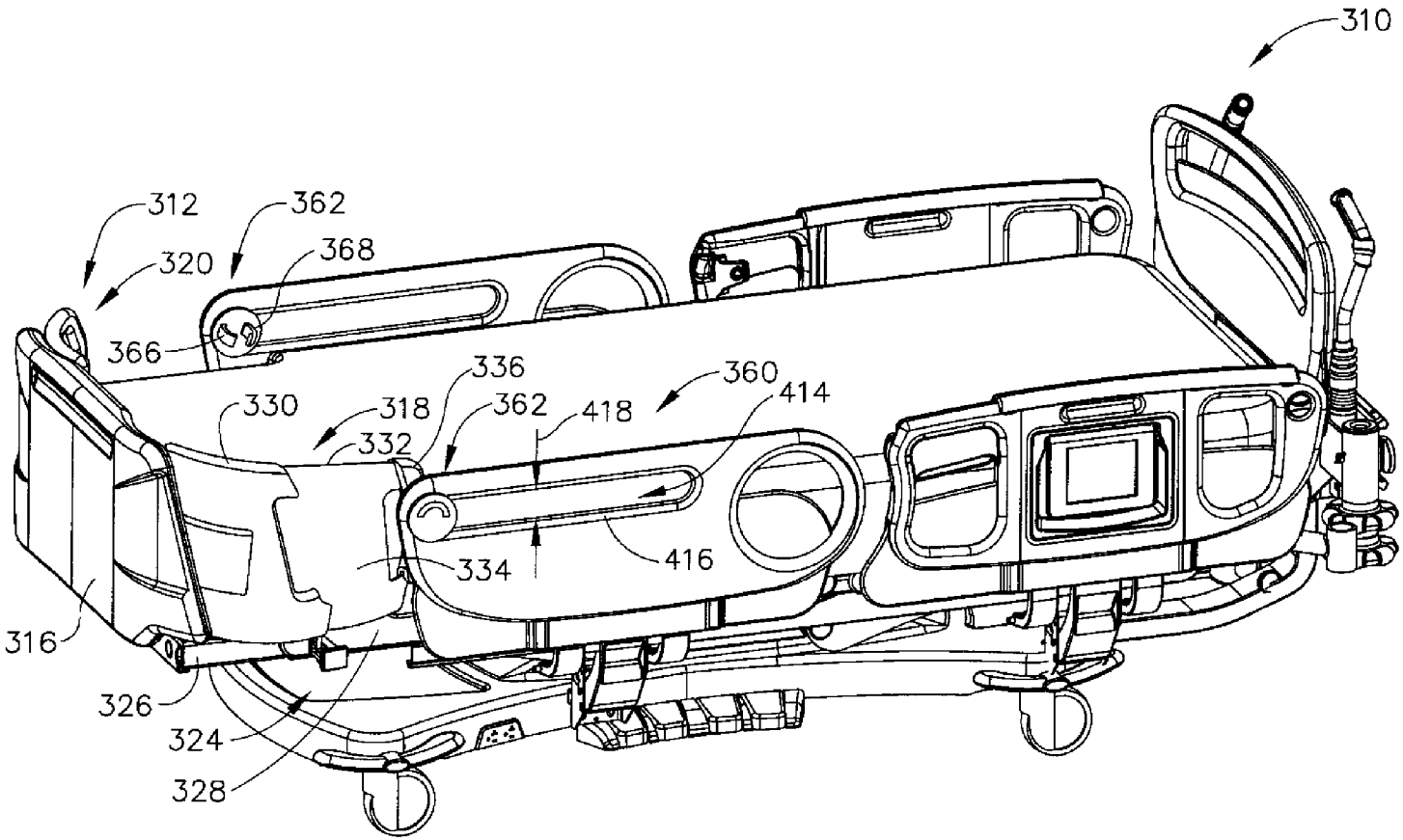
FIG. 11 is similar to FIG. 10, the end panel shown in FIG. 11 having extenders of the end panel in their a respective extended positions, the first extender engaged with a portion of a frame of the patient-support apparatus and the second extender engaged with a bracket coupled to a siderail of the patient-support apparatus.

Movement of moving portion 326 relative to fixed portion 328 between a retracted position shown in FIG. 10 and an extended position shown in FIG. 11 automatically extends and retracts extenders 318 and 320. The structure of extender 318 will be described in more detail below. It should be understood that the structure of extender 320 is similar with extender 320 positioned on the opposite side of end panel 312 such that extender 320 is a right-side version of left-side extender 318.

Figure 9:
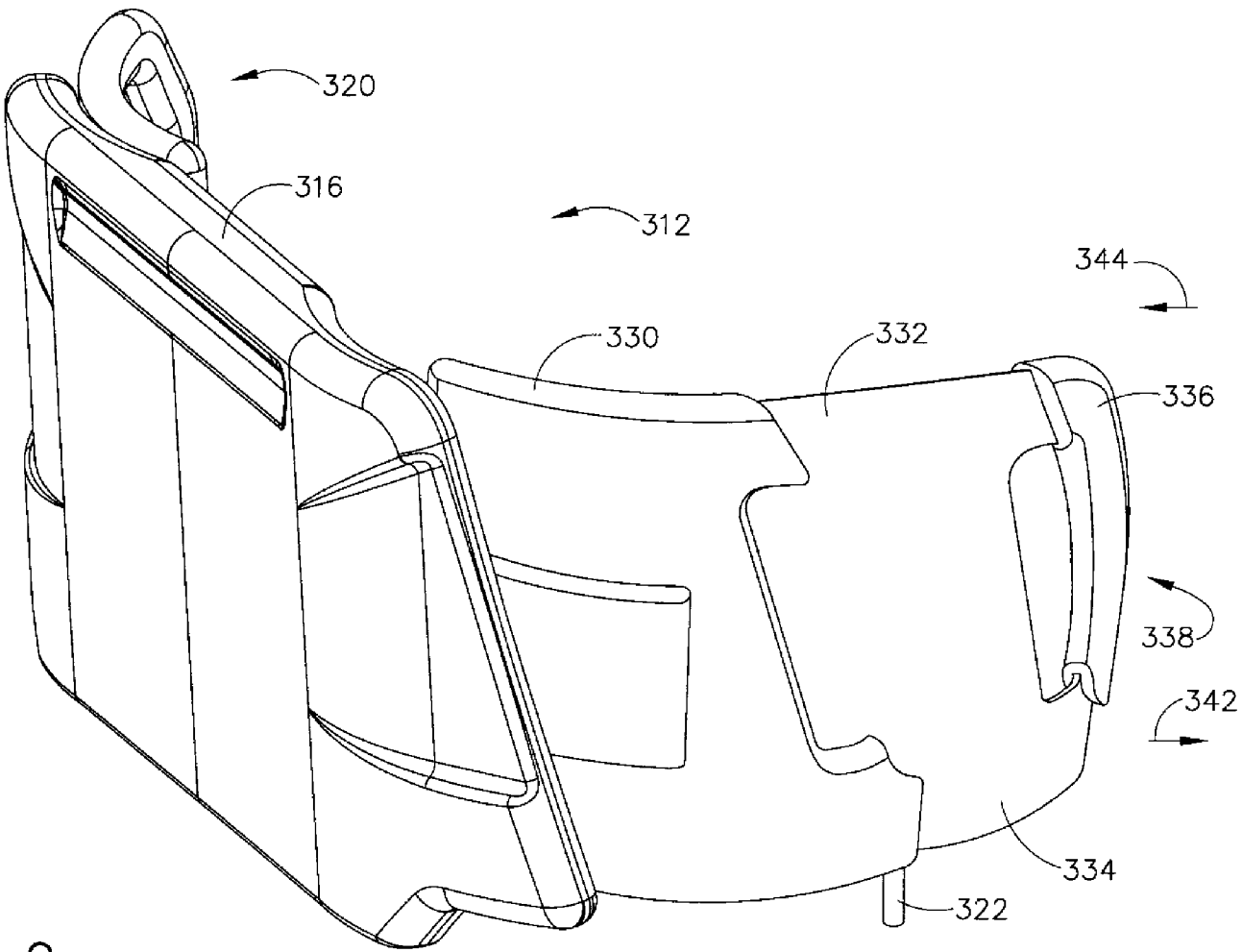
FIG. 9 is a perspective view of another embodiment of an end panel similar to the embodiment of FIGS. 6-8, the end panel of FIG. 9 including a body, a first extender which extends relative to the body, and a second extender that extends relative to the first extender.

Extender 318 comprises a first portion 330 and a second portion 332. First portion 330 is structured similar to extender 218 but includes the engagement pin 322. Second portion 332 is engaged with first portion 330 and movable relative thereto to extend away from first portion 330 and body 316. Second portion 332 includes a panel 334 and a grip 336 coupled to panel 334. Panel 334 and grip 336 cooperate to form a handle 338 which is configured to be grasped by a user to extend second portion 332 relative to first portion 330. In some embodiments, engagement pin 322 may be omitted and the handle 338 may be used to extend second portion 332 and first portion 330. For example, when the extender 318 is in a retracted position similar to the position of extender 320 in FIG. 9, pulling on second portion 332 will extend second portion 332 relative to first portion 330. Once second portion 332 has been fully extended, additional pulling on handle 338 will extend first portion 330 relative to body 316. When handle 338 is pushed toward body 316, second portion 332 will move toward a retracted position until fully retracted and then additional pushing will tend to cause first portion 330 to retract relative to body 316. Referring to FIG. 9, the direction of pull/extension is depicted by arrow 342 and the direction of push/retraction is depicted by arrow 344.

Figure 14:
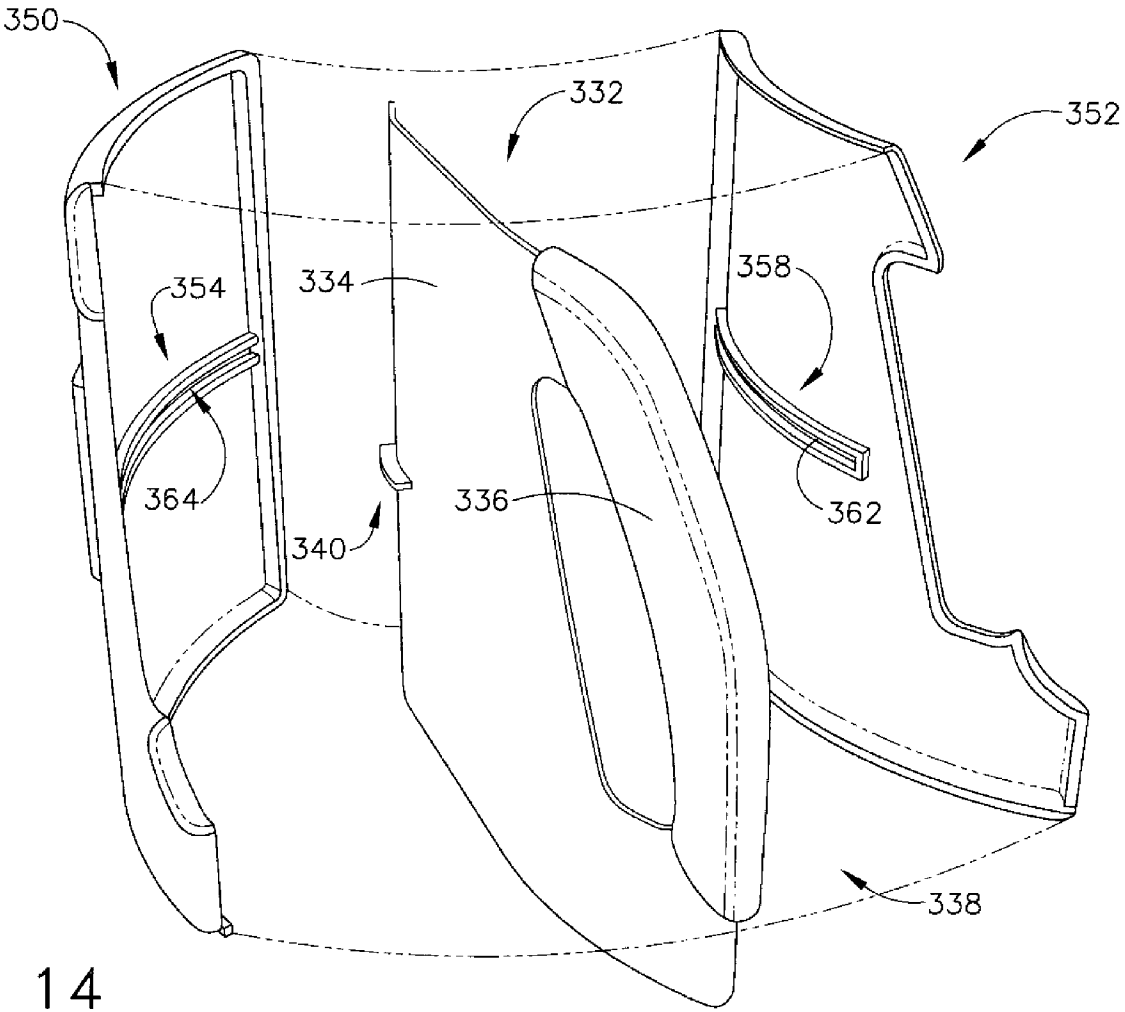
FIG. 14 is an exploded view of the first and second extenders of the end panel of FIGS. 11-13.
Figure 15:
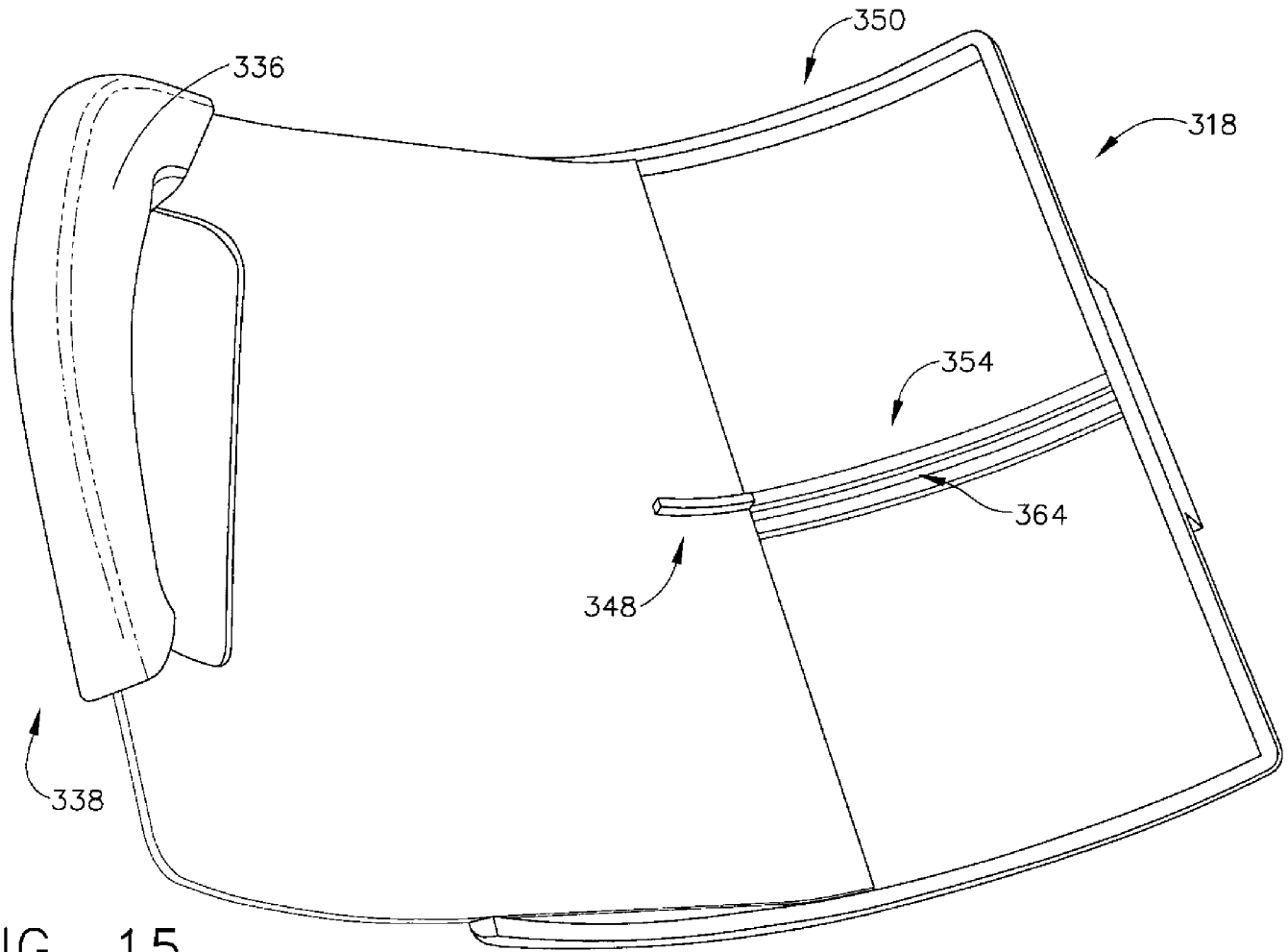
FIG. 15 is a perspective view of the second extender of the end panel of FIGS. 11-14 engaged with a portion of the first extender.

Referring now to FIG. 14, an exploded view of extender 318 shows the structure of first portion 330 and second portion 332. First portion 330 comprises two mating panels 350 and 352. Panel 350 includes a guide 354 formed on an inner surface 356. Panel 352 includes a guide 358 formed on an inner surface 360. Guide 358 includes a channel 362 configured to receive a tab 348 (FIG. 15). Guide 354 includes a channel 364 configured to receive a tab 340. When panels 350 and 352 are coupled, tabs 340 and 348 are received in guides 354 and 358 respectively such that tabs 340 and 348 and guides 354 and 358 cooperate to support second portion 332 relative to first portion 330 during extension and retraction. As tabs 340 and 348 reach the terminal ends of guides 354 and 358, engagement of the tabs 340 and 348 with the terminations causes forces to be transferred through the tabs to the panels 350 and 352. The transfer of force acts on panels 350 and 352 to cause first portion 330 to extend and retract relative to body 316.

When panels 350 and 352 are coupled, an opening is formed to permit second portion 332 extend relative to first portion 330. Illustratively, panels 350 and 352 are glued together to form first portion 330. In some embodiments, panels 350 and 352 may be secured to one another by a fastener, welding, heat staking or other mechanical process.

Figure 12:
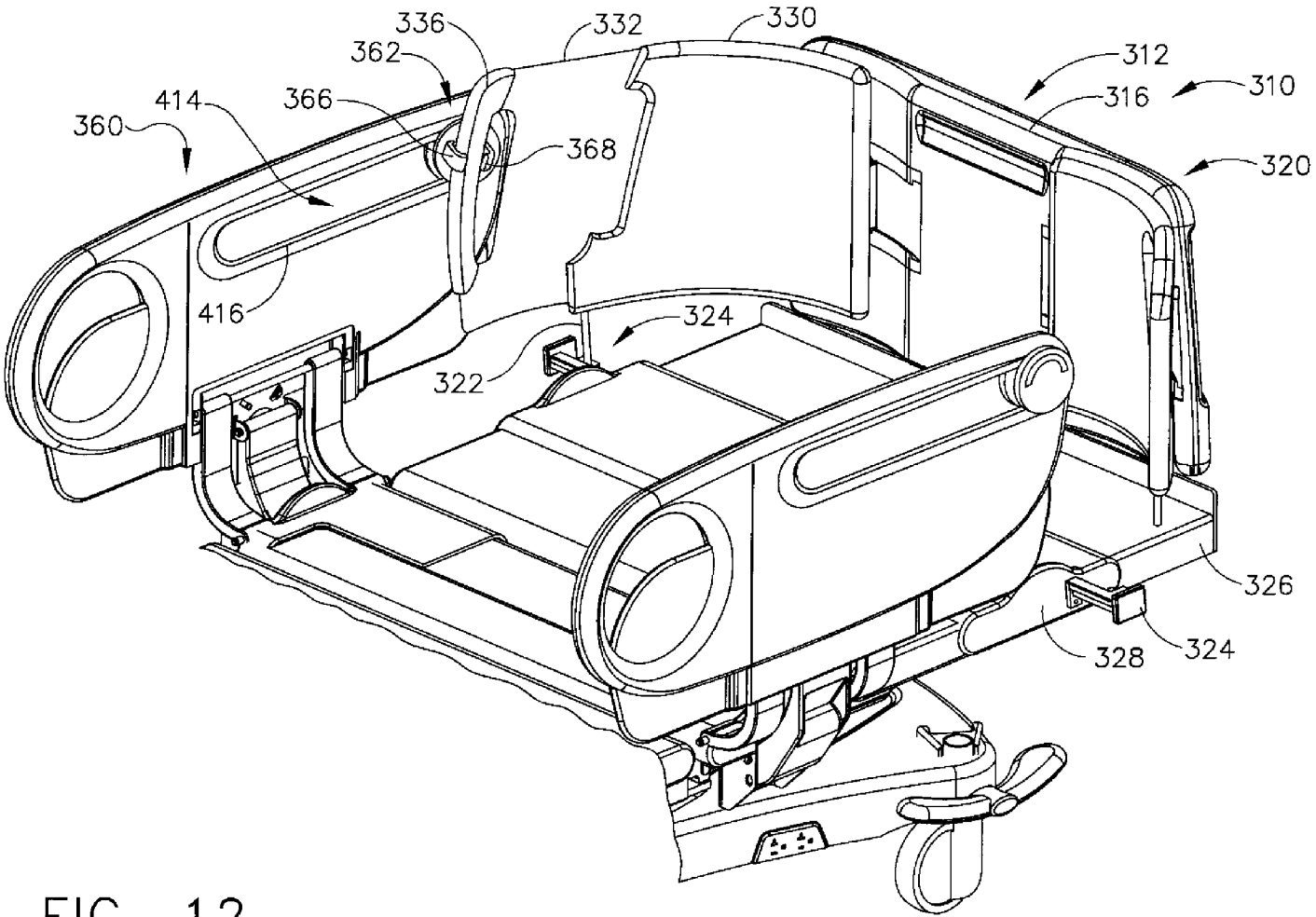
FIG. 12 is a perspective view of a portion of the patient-support apparatus of FIG. 11, FIG. 12 showing the second extender the engaged with the bracket on the inside of a siderail of the patient-support apparatus.

In the illustrative embodiment of FIGS. 10-12, second portion 332 is securable to a siderail 360 of patient-support apparatus 310 by a bracket 362. Bracket 362 includes a body 364 and two arms 366 and 368 which are configured to engage the grip 336 of second portion 332. Bracket 362 maintains second portion 332 in an extended position such that the gap between siderail 360 and body 316 of end panel 312 is fully enclosed by extender 318. Engagement pin 322 is received in coupler 324 such that first portion 330 extends and retracts with the extension and retraction of moving portion 326 of frame 314 relative to fixed portion 328.

Figure 28:
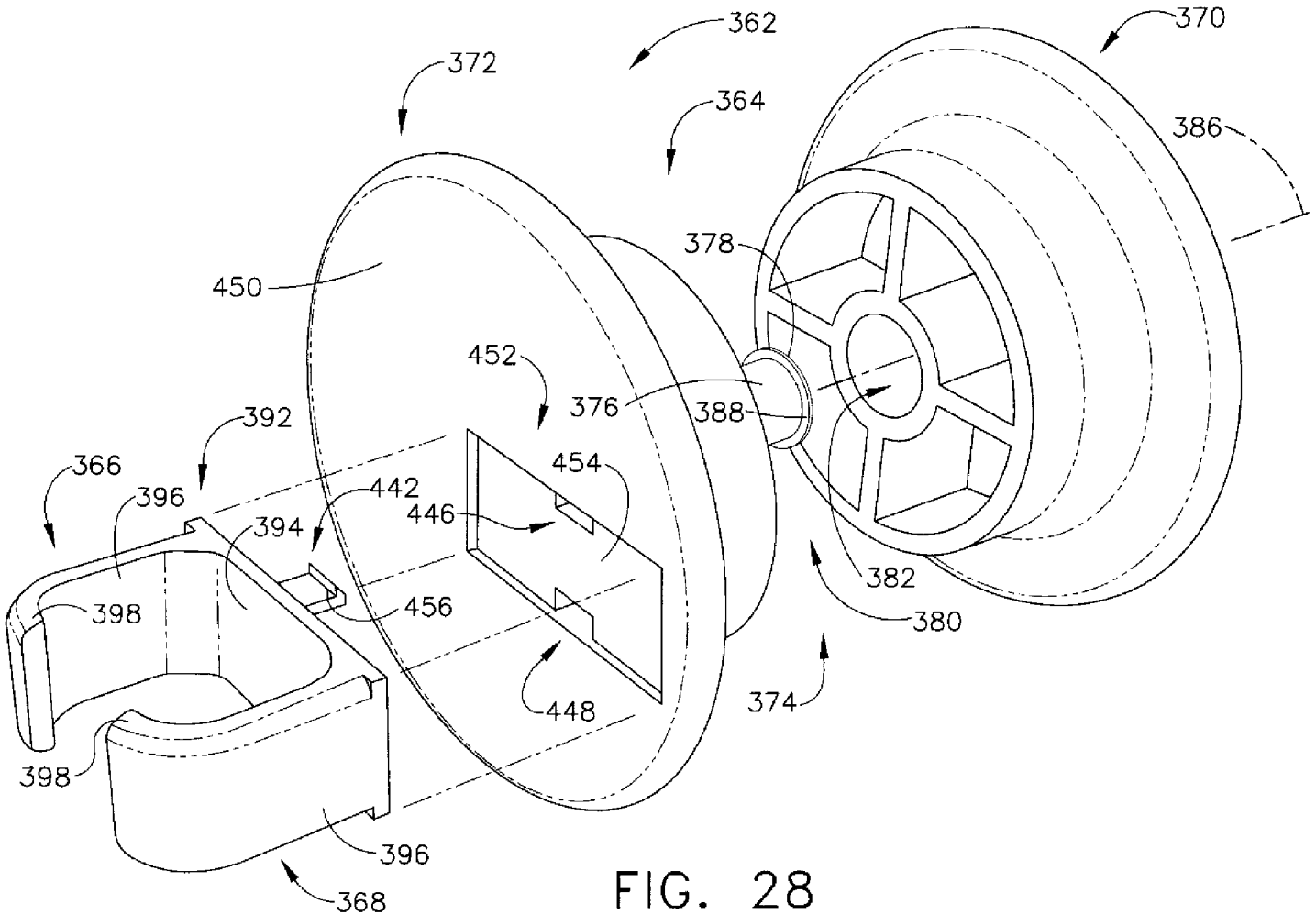
FIG. 28 is an exploded assembly view of another embodiment of a bracket similar to the bracket of FIG. 24.
Figure 29:
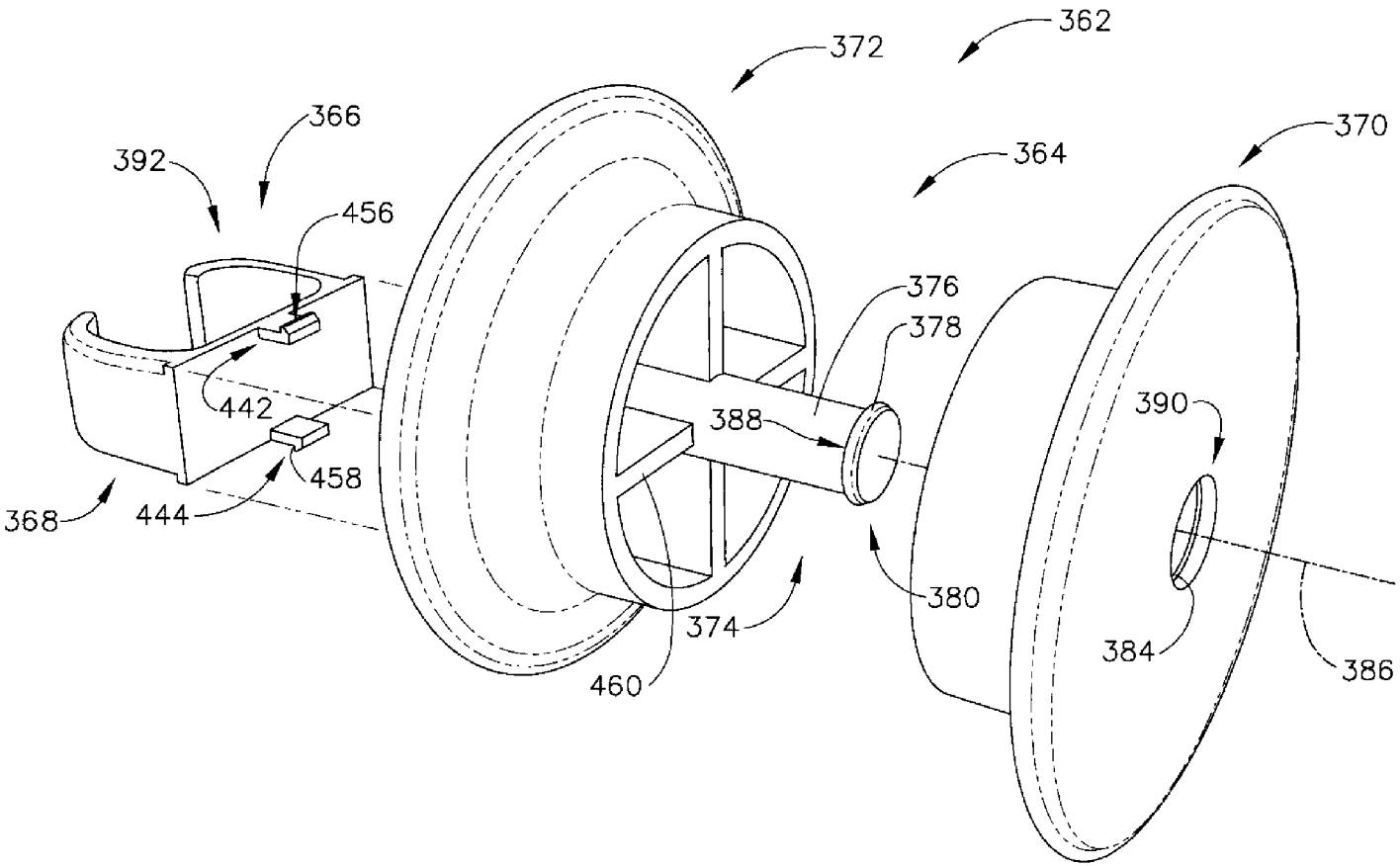
FIG. 29 is another exploded assembly view of the bracket of FIG. 28.

Bracket 362 illustratively includes an outer body portion 370 and an inner body portion 372 which are coupled to form body 364 as suggested in FIGS. 28 and 29. Body portions 370 and 372 are secured by a snap-fit between portions thereof. Specifically, body portion 372 is formed to include a stud 374 which includes a cylindrical shaft 376 and an annular flange 378 formed at an end 380 of stud 374. Body portion 370 includes a cylindrical through-hole 382 with an annular surface 384 which is generally perpendicular to an axis 386 of through-hole 382. Through-hole 382 is sized such that flange 378 deflects when inserted into through-hole 382. When body portion 370 is mated to body portion 372, flange 378 passes through through-hole 382 until flange 378 is received in a cavity 390 formed in an outer surface 392 of body portion 370. When flange 378 is received in cavity 390, flange 378 expands and a surface 388 of flange 378 is engaged with surface 384 such that body portions 370 and 372 are secured together.

Bracket 362 further includes a clamp 392 which includes arms 366 and 368 which are each coupled to a base 394 and extend therefrom. Each arm 366, 368 has a leg 396 and a hook 398 which extends away from leg 396 toward the opposite arm 366 or 368. Grip 336 of second portion 332 is sized to be received to between arms 366 and 368 such that the hooks 398, 398 extend around grip 336 to retain second portion 332 on bracket 362. Clamp 392 is formed such that arms 366 and 368 deflect to permit grip 336 to be inserted between arms 366 and 368. Arms 366 and 368 comprise an elastic material. When grip 336 is pushed into clamp 392, arms 366 and 368 deflect to permit insertion of grip 336 and the arms 366 and 368 return to their natural shape such that they have sufficient strength to retain second portion 332 until a force is applied by a user to release grip 336.

Clamp 392 is secured to flange 372 by two tabs 442 and 444 which are sized to be received in two slots 446 and 448 formed in flange 372. Base 394 is received by a cavity 452 formed in a generally planar surface 450 of flange 372. Cavity 452 includes a surface 454 which is generally planar a parallel to surface 450. Slots 446 and 448 are formed in surface 450. Tab 442 is formed to include a surface 456. When tab 442 is inserted into slot 452, surface 456 snaps over a surface (not shown) on flange 372. Similarly, tab 444 is formed to include a surface 458 which snaps over a surface (not shown) when tab 444 is inserted slot 448. Engagement of surfaces 456 and 458 of tabs 442 and 444 with flange 372 retains clamp 392 on flange 372. As shown in FIG. 28, clamp 392 is positioned such that it is not centered on axis 386. This permits tabs 442 and 444 to be inserted through a wall of flange 372 and clear the rib 460 of flange 372.

In another embodiment, a bracket 400 includes a clamp 402 having two arms 404 and 406 which move relative to one another to open clamp 402. Bracket 400 also includes a body 408 which is configured to be received in a siderail. For example, in the illustrative embodiment of FIGS. 10-12, bracket 362 may be omitted and replaced with bracket 400. Body 408 is an annular structure having two flanges 410 and 412. Body 408 comprises an elastic material which allows flange 410 or 412 to be deflected such that body 408 may be inserted into a siderail by user. For example, body 408 may be inserted in siderail 360. Siderail 360 is formed to include an elongate aperture 414 bounded about a perimeter by a convex semicircular surface 416. Aperture 414 is sized such that a gap 418 that separates opposing portions of surface 416 allows body 408 to be inserted into gap 418 by deflecting flange 410 or 412. Body 408 includes a concave semicircular surface 420 which is sized to engage surface 416 of siderail 360. Thus, body 408 is configured to be snapped into aperture 414 to secure bracket 400 to siderail 360.

Bracket 400 further includes an actuator 422 which, when depressed, causes arms 404 and 406 to open to release clamp 402. When actuator 422 is depressed, clamp 402 opens to receive grip 336 of second portion 332. Once the grip 336 is positioned in the clamp 402, releasing actuator 422 causes clamp 402 to close such that arms 404 and 406 engage grip 336 and secure second portion 332 to siderail 360.

Figure 25:
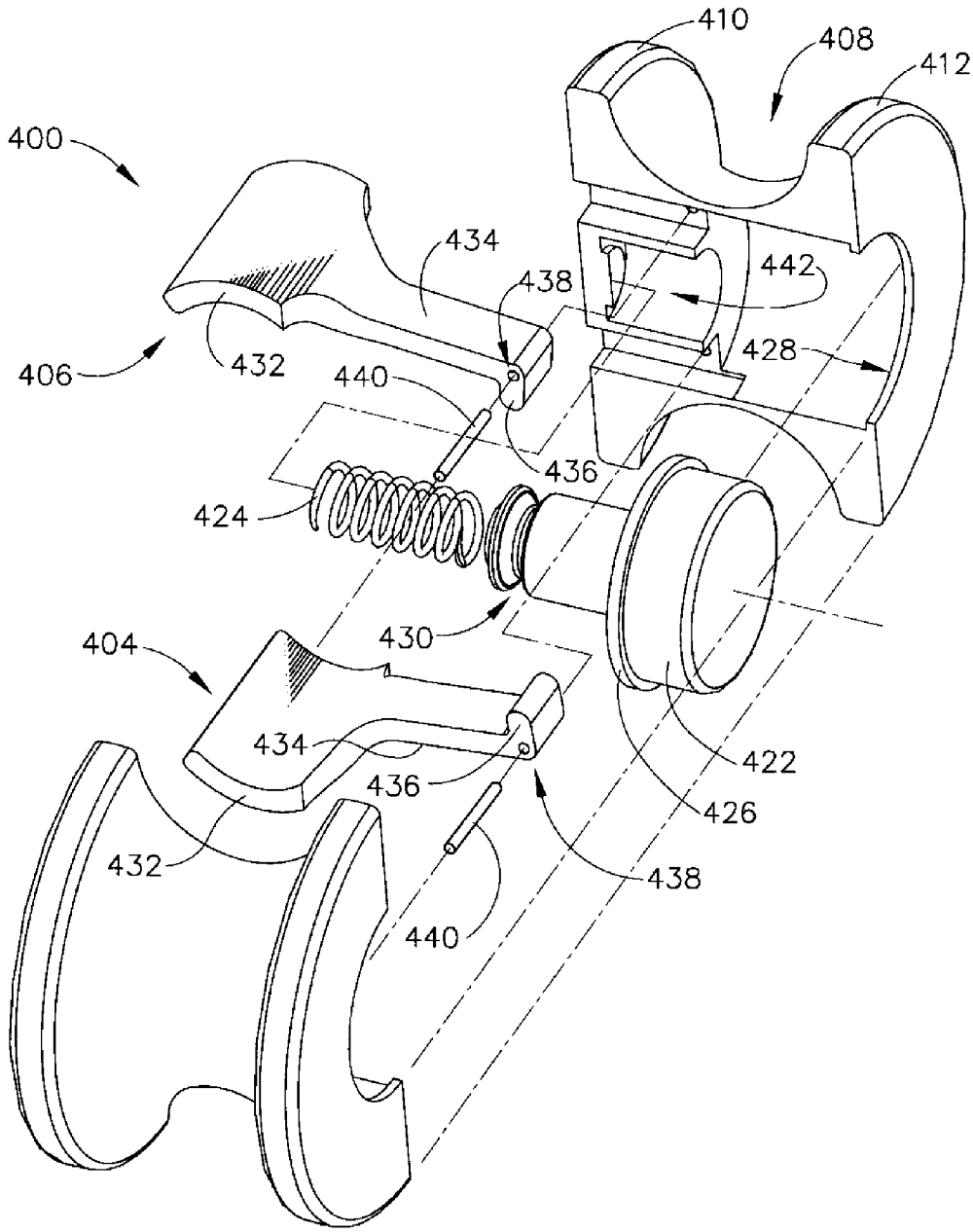
FIG. 25 is an exploded assembly view of the bracket of FIG. 24.
Figure 26:
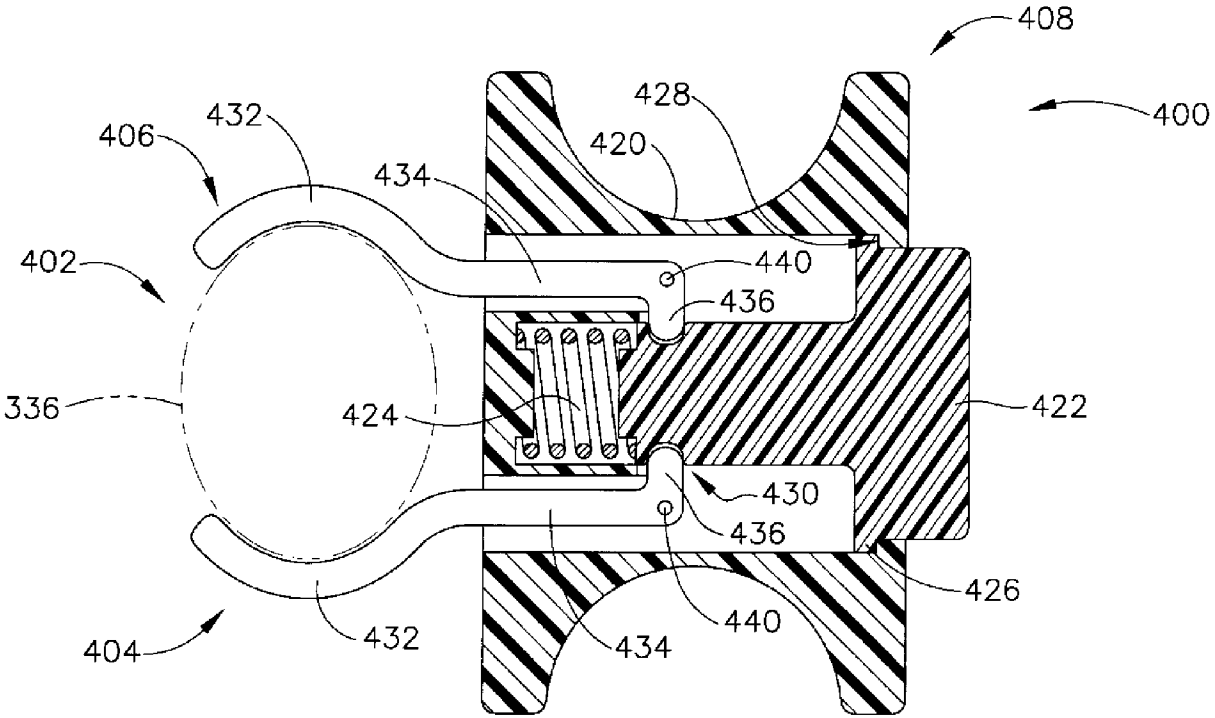
FIG. 26 is a cross-sectional view of the bracket of FIG. 24 with a clamp in a closed position.
Figure 27:
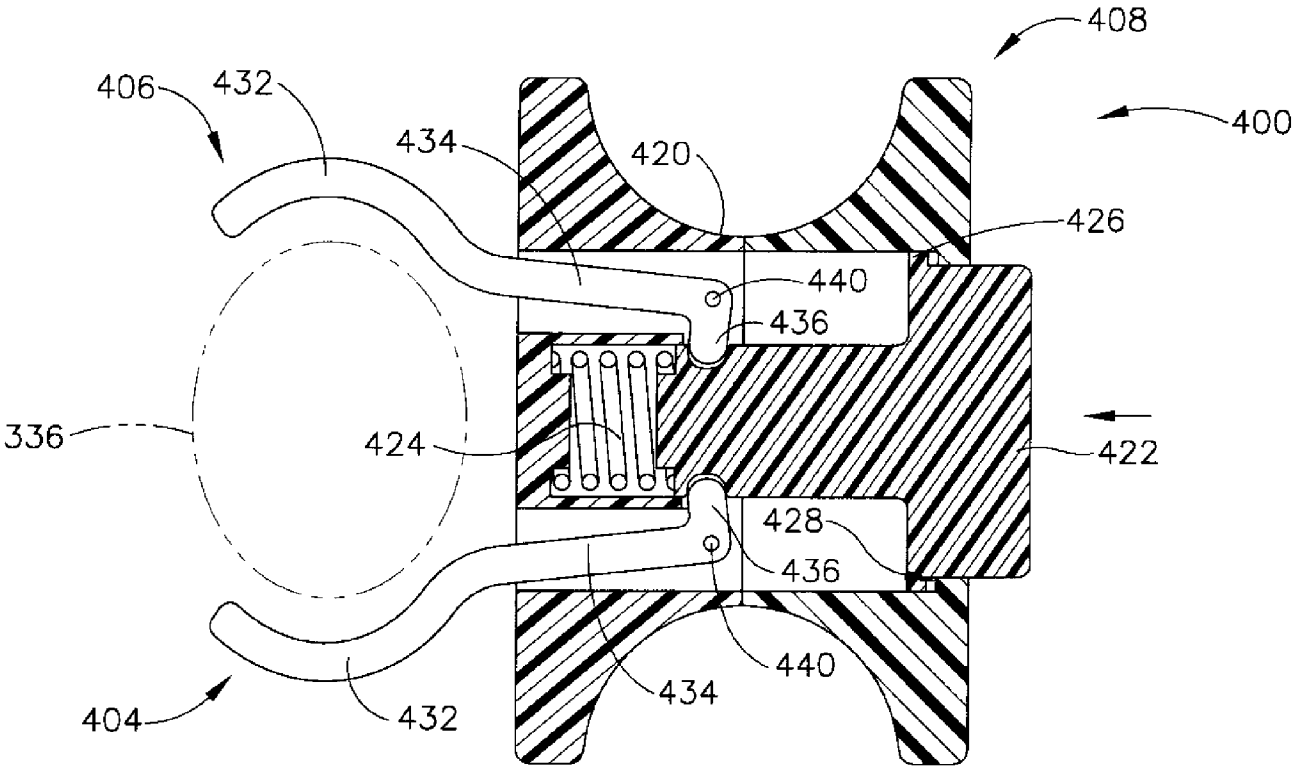
FIG. 27 is a cross-sectional view similar to FIG. 26, the clamp in a released position in FIG. 27.

As illustrated in FIGS. 25-27, actuator 422 is biased by a compression spring 424 which also acts on arms 404 and 406 to close clamp 402. Actuator 422 includes an annular flange 426 which engages an annular surface 428 of body 408 that retains actuator 422 within body 408. Actuator 422 further includes an annular channel 430. Arms 404 and 406 have the same geometry including a grip 432, a leg 434 coupled to the grip 432, and a pivot arm 436 coupled to leg 434 and extending generally perpendicular to leg 434. Pivot arm 436 engages with annular channel 430 of actuator 422. Arms 404 and 406 further include a through-hole 438 that is configured to engage a pivot pin 440 about which arm 404 or 406 pivots to open or close clamp 402. Body 408 is formed to define a cylindrical spring housing 442 in which spring 424 is positioned when bracket 400 is assembled.

Referring to FIG. 26, spring 424 urges actuator 422 into contact with surface 428 of body 408. In the position illustrated in FIG. 26, pivot arms 436, 436 are in a neutral position such that arms 404 and 406 of clamp 402 are closed about grip 336 to secure second portion 332 to siderail 360. When actuator 422 is depressed as shown in FIG. 27, pivot arms 436, 436 are urged downwardly such that arms 404 and 406 pivot about pivot pins 440, 440 to open arms 404 and 406 such that grips 432, 432 release grip 336 of second portion 332. Spring 424 biases clamp 402 such that when actuator 422 is released, arms 404 and 406 of clamp 402 return to the closed position of FIG. 26. Thus, bracket 400 is interchangeable with bracket 362.

Figure 16:
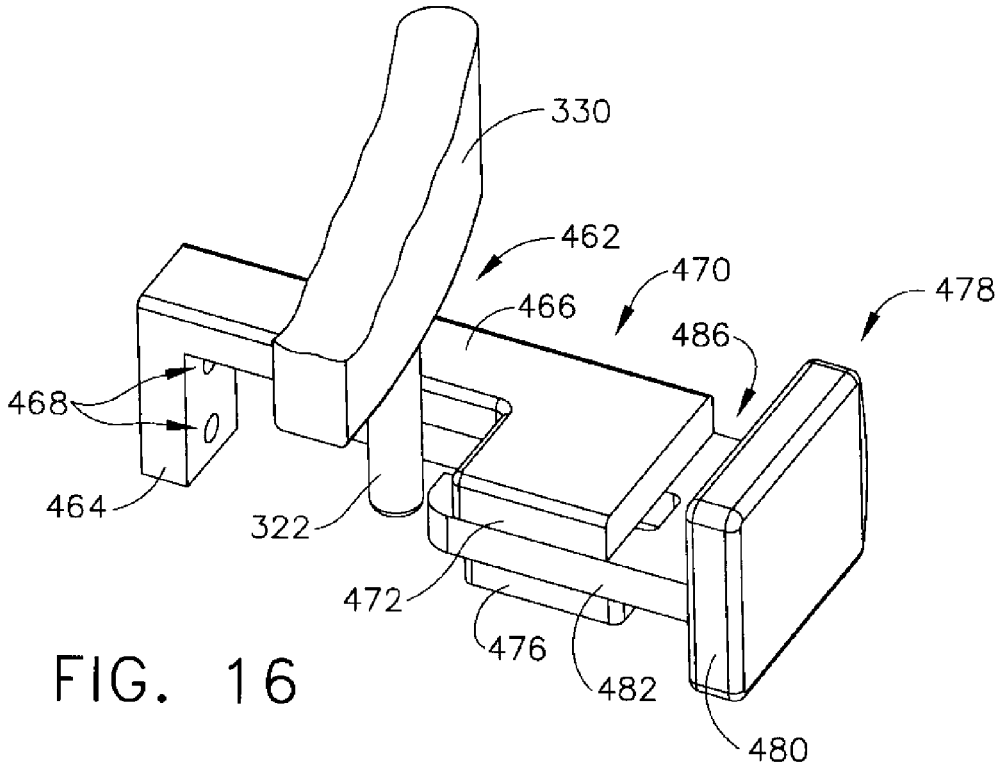
FIG. 16 is a perspective view of an embodiment of a coupler configured to be attached to a fixed portion of a frame of a patient-support apparatus, the coupler configured to receive an engagement pin of a first extender of an end panel.
Figure 17:
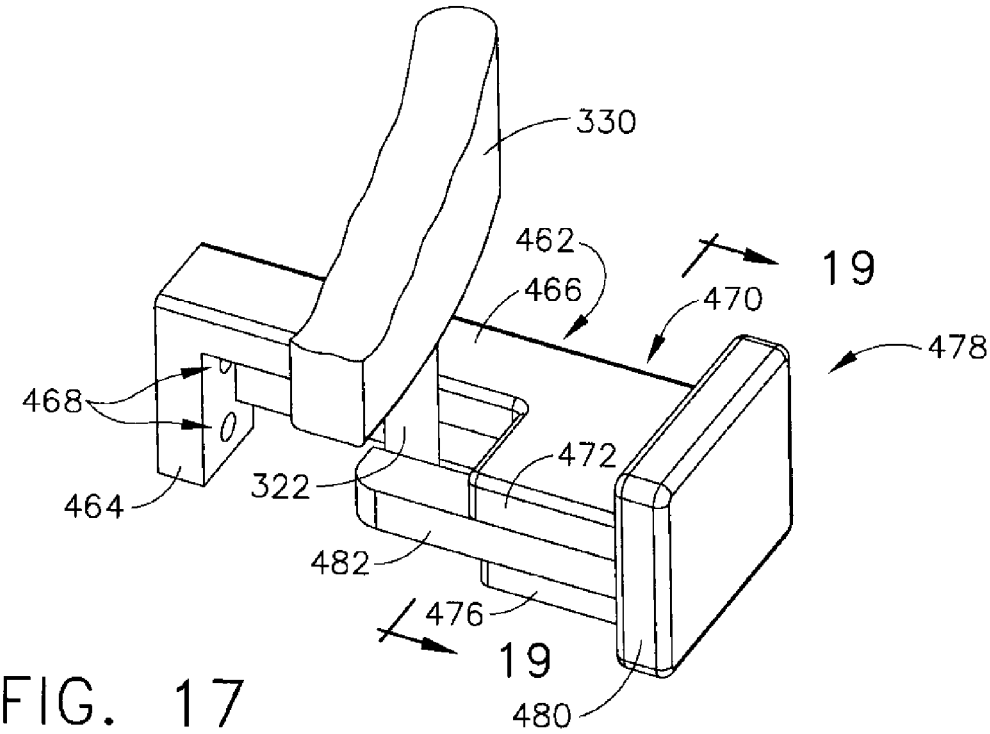
FIG. 17 is a view similar to FIG. 16, the coupler shown in an engaged position in FIG. 17.
Figure 18:
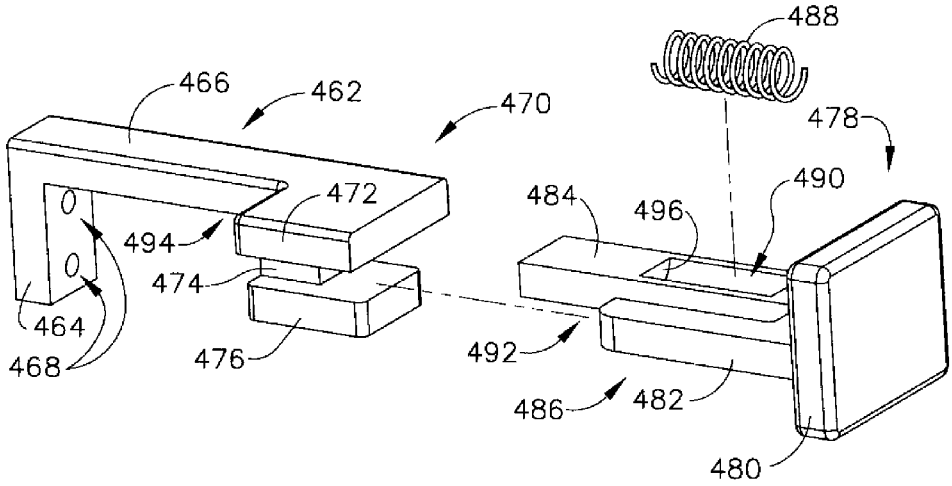
FIG. 18 is an exploded assembly view of the coupler of FIGS. 16 and 17.

In the illustrative embodiment of FIGS. 10-12, engagement pin 322 is received in coupler 324 which is secured to fixed portion 328 of frame 314. Coupler 324 is spring biased to a closed position to retain engagement pin 322 as shown in FIG. 17. A support 462 includes a mount 464 and an extension 466 coupled to mount 464. Two through-holes 468 are formed in mount 464 and configured to receive fasteners (not shown) to secure mount 464 of support 462 to fixed portion 328. Support 462 further includes a slide frame 470 coupled to extension 466. Slide frame 470 includes a main portion 472, a guide 474 coupled to main portion 472 and extending vertically downwardly therefrom, and a slide base 476 coupled to guide 474 and vertically spaced from main portion 472. Guide 474 is narrower than main portion 472 and slide base 476 such that slide frame 470 is generally I-shaped. A slider 478 is configured to engage slide frame 470 and be supported thereon. Slider 478 includes a handle 480 and a slide member 486 coupled to handle 480 and extending therefrom. Slide member 486 includes a frame 484 and a leg 482 which is spaced apart from frame 484 by a gap 492. The spacing of gap 492 between frame 484 and leg 482 is sized to receive guide 474 of slide frame 470. Slider 478 engages with slide frame 470 and is supported thereon. Movement of slider 478 between the position shown in FIG. 16 and the position shown in FIG. 17 results in engagement pin 322 being positioned in gap 492 and leg 484 retaining engagement pin 322. Engagement pin 322 is secured to fixed portion 328 in the position of FIG. 17 and is free to move relative to fixed portion 328 when slider 478 is in the position of FIG. 16.

Figure 19:
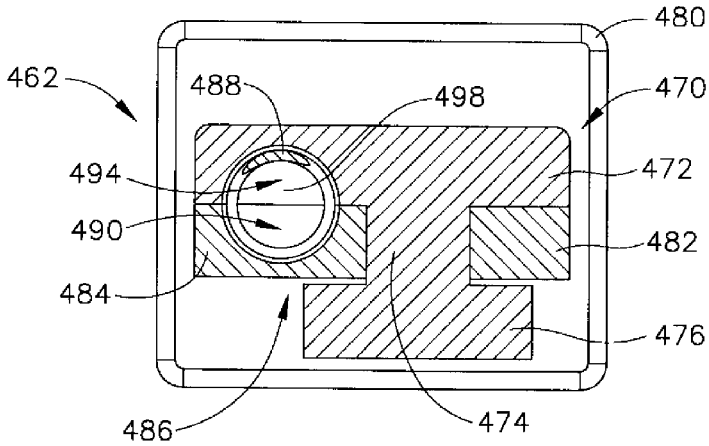
FIG. 19 is a cross-sectional view of the coupler of FIGS. 16-18, the cross-section take along lines 19-19 in FIG. 17.

Slider 478 is biased to the position shown in FIG. 17 by a spring 488 which is received in a cavity 490 formed in frame 484 and a cavity 494 formed in extension 466 of slide frame 462. When slider 478 is moved to the position shown in FIG. 16, spring 488 is compressed between a surface 496 of cavity 490 and a surface 498 (see FIG. 19) of cavity 494. Release of slider 478 results in spring 488 biasing slider 478 to the position of FIG. 17 such that handle 480 engages main portion 472 and slide base 476 of support 462.

Figure 13:
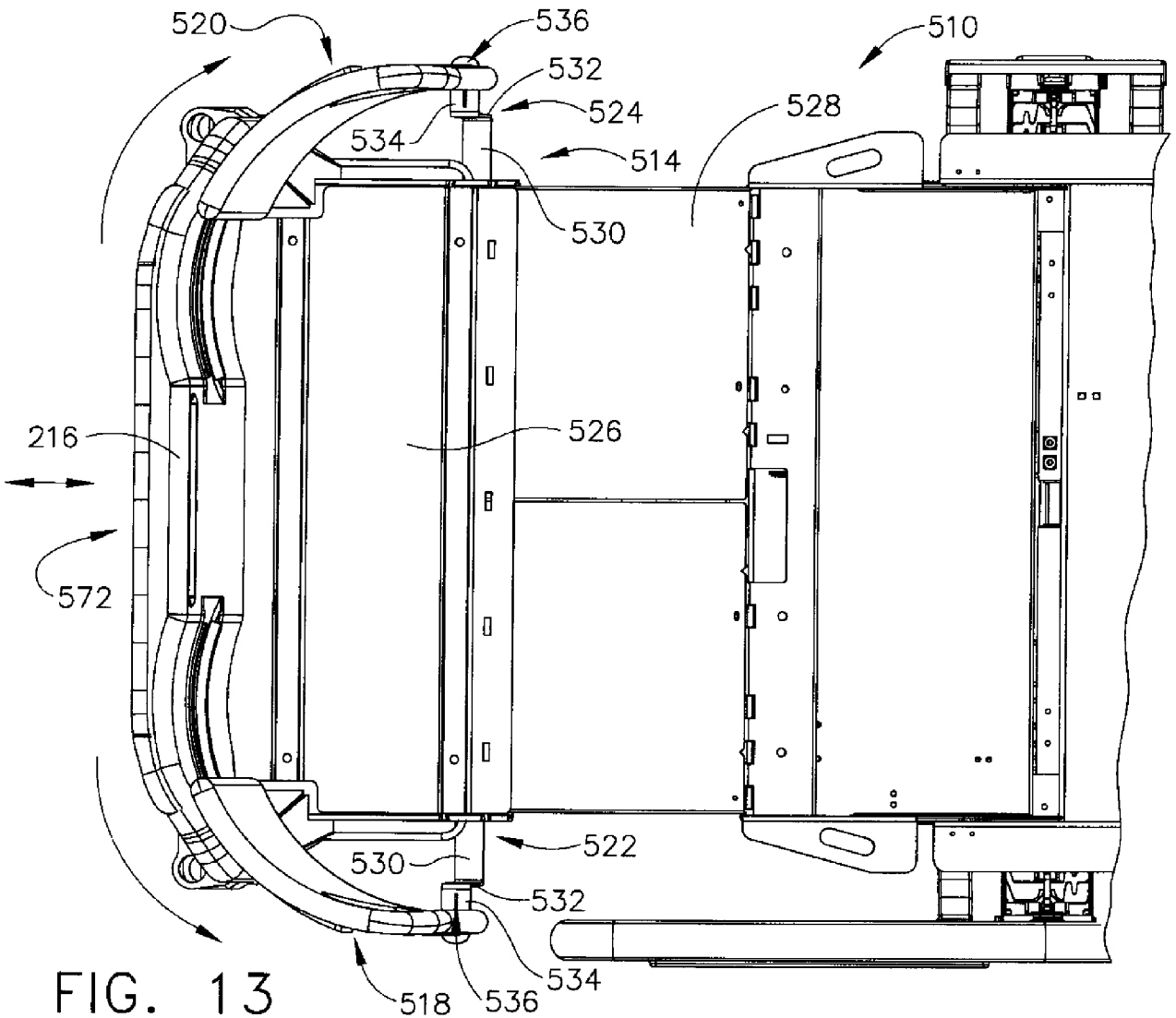
FIG. 13 is a top view of the end panel of FIG. 11, the end panel mounted on a moving portion of a frame of a patient-support apparatus with the first extender of the end panel engaged with a fixed portion of the foot deck and the moving portion of the frame extended relative to the fixed portion to cause the first extenders of the end panel to extend relative to a main portion of the end panel.
Figure 23:
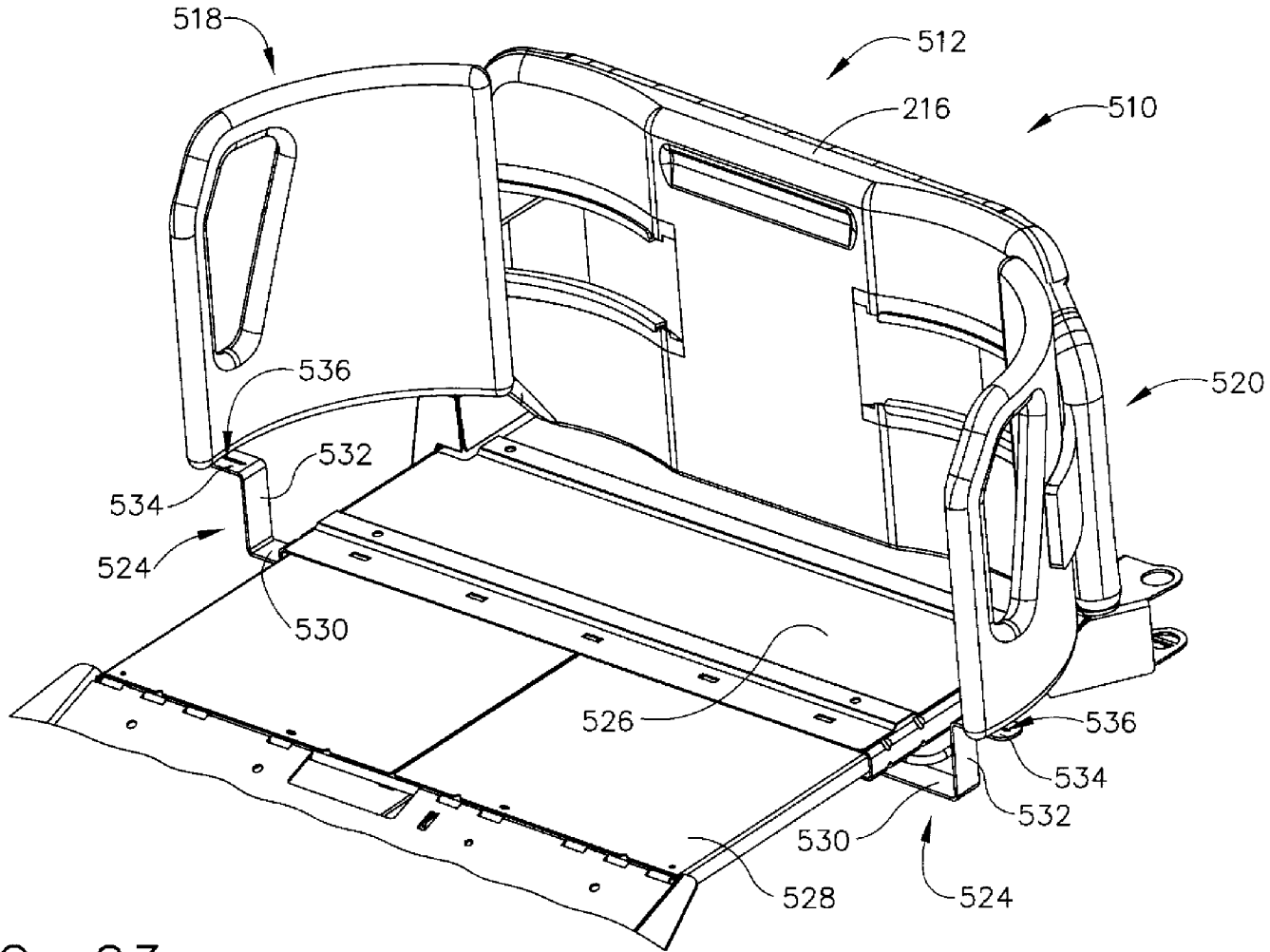
FIG. 23 is a perspective view of the end panel and frame of FIG. 13.
Figure 24:
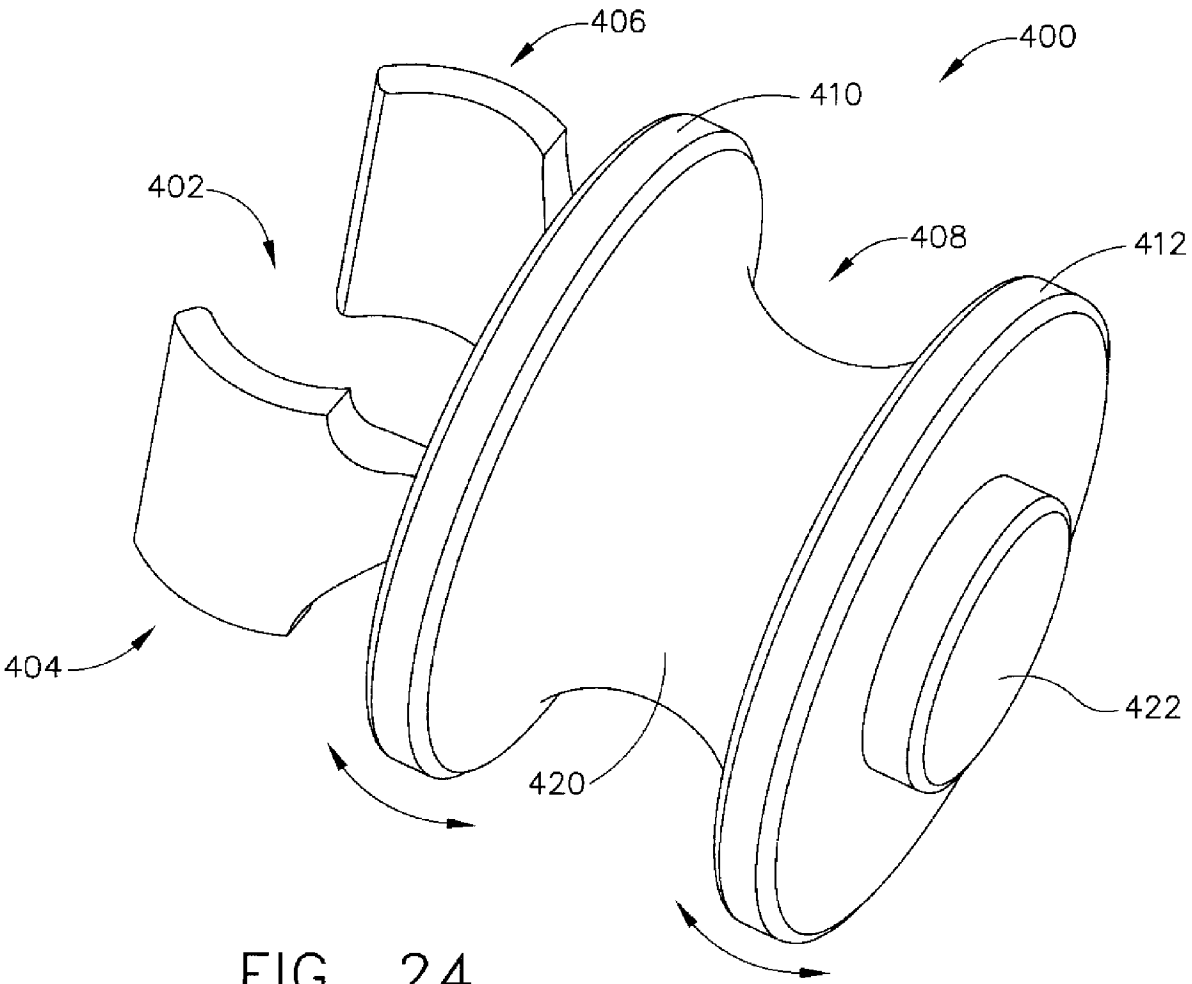
FIG. 24 is a perspective view of an embodiment of a bracket configured to coupled to a siderail of a patient-support apparatus and a second extender of the end panel to hold the second extender in position such that the first and second extenders form a barrier between a siderail and an end panel of a patient-support apparatus.

In another embodiment of a patient-support apparatus 510, an end panel 512 is supported on a frame 514 as shown in FIGS. 13 and 23. Frame 514 includes a fixed portion 528 and a moving portion 526 which is movable relative to fixed portion 528 to extend frame 514. Fixed portion 528 includes two couplers 522 and 524. End panel 512 includes two extenders 518 and 520 similar to the extenders 218 and 220 of the embodiment of FIGS. 7 and 8. Extenders are coupled to a main portion 216 which was described in detail in the discussion of the illustrative embodiment of FIGS. 7 and 8. Extenders 518 and 520 are engaged with main portion 216 as described with reference to extenders 218 and 220 above. However, extenders 518 and 520 further include two engagement pins (not shown) that are received in couplers 522 and 524 respectively when end panel 512 is positioned on frame 514. In the illustrative embodiment of FIGS. 13 and 23, couplers 522 and 524 are not configured to release extenders 518 and 520. Extenders 518 and 520 are configured to always extend and retract with movement of moving portion 526 relative to fixed portion 528. Illustratively, couplers 522 and 524 are coupled to the bottom of fixed frame 528 by a base 530. A leg 532 is coupled to and extends vertically from base 530. A receiver 534 is coupled to leg 532 and extends generally horizontally outwardly from frame 514. An aperture 536 formed in receiver 534 is configured to receive the engagement pin of the extender 518 or 520.

While the couplers 522 and 524 of the illustrative embodiment of FIGS. 13 and 23 extend from beneath fixed portion 528, it should be understood that a coupler may be positioned in any of a number of positions on fixed portion 528. Also, couplers 324 and 522, 524 may be interchanged. In some embodiments, a coupler such as coupler 522 may be used in combination with bracket 362 or bracket 400. In some embodiments, bracket 362 or bracket 400 may be omitted and coupler 324 may be used alone. In some embodiments, an extender may have a first portion and a second portion which extends relative to the first portion, wherein the first portion does not include an engagement pin, but the second portion does couple to a bracket such as bracket 362 or bracket 400.

Figure 31:
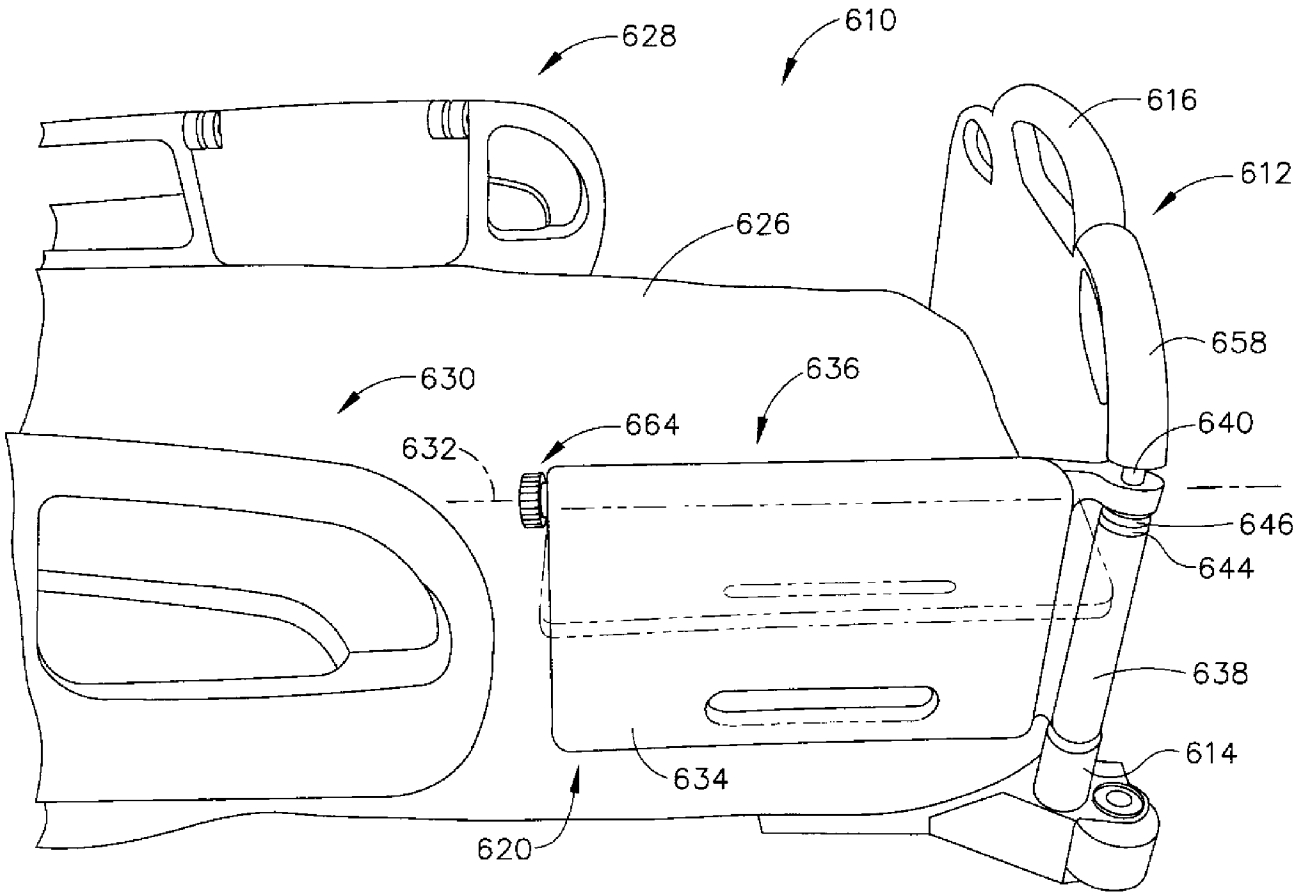
FIG. 31 is a perspective view similar to FIG. 30.
Figure 32:
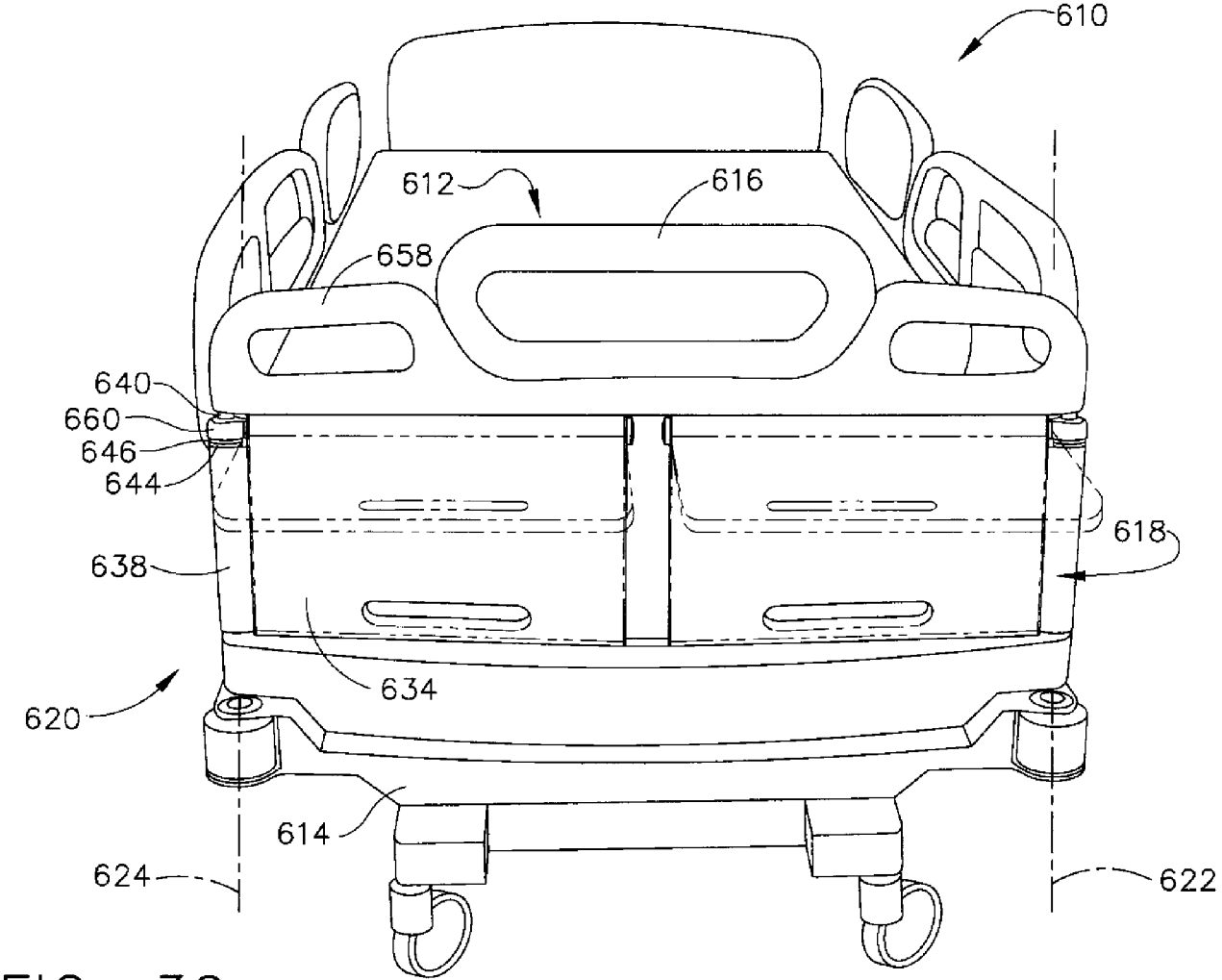
FIG. 32 is an end view of the patient-support apparatus of FIG. 31, the end panel having two extenders shown in a stowed position in solid and in a shelf position in phantom.

In yet another embodiment, an end panel 612 is coupled to a frame 614 of a patient-support apparatus 610 and includes two panels 618 and 620 which are each pivotable about a generally vertical axis as shown in FIG. 32. Moving portion 618 is pivotable about an axis 622 and moving portion 620 is pivotable about an axis 624. In addition, each panel 618, 620 is pivotable about a generally horizontal axis between a first position wherein the panel 618 or 620 is in a generally vertical configuration as shown in solid in FIGS. 31 and 32, and second position wherein the panel 618 or 620 is in a generally horizontal configuration as shown in phantom. In the vertical configuration, panels 618 and 620 may be positioned alongside a mattress 626 supported on patient-support apparatus 610 to form a barrier in the gap between siderails 628 and 630 respectively, and end panel 612. In the horizontal configuration, panels 618 and 620 may be positioned to serve as a shelf or a work surface for a caregiver.

Panel 620 is pivotable about a generally horizontal axis 632 between the vertical configuration shown in solid and the horizontal configuration shown in phantom. Panel 620 comprises a body 634 supported on a positioner 636. The positioner 636 is adjustable to position the panel 620 about axis 624 and about axis 632. End panel 612 includes a support column 638 which supports a pivot shaft 640 which defines pivot axis 624. Positioner 636 includes a detent assembly 642 which maintains panel 620 in either the barrier position shown in FIG. 31 or in the stowed position shown in FIG. 32. Detent assembly 642 includes a lower plate 644 and an upper plate 646. Lower plate 644 includes a tab 648 which is configured to engage a slot 652 in upper plate 646 to prevent movement of positioner 636 about axis 624. Lower plate 644 also includes a central through-hole 654 through which pivot shaft 640 passes. In addition, lower plate 644 includes two counter-sunk mount holes which receive two fasteners 656 which secure lower plate 644 to support column 638. Pivot shaft 640 is coupled to support column 638 and an upper portion 658 of a main portion 616 of end panel 612.

Upper plate 646 includes two slots configured to engage tab 648 of lower plate 644. Slot 652 is positioned to engage tab 648 when panel 620 is in the stowed position of FIG. 32. A second slot (not shown) is positioned approximately ninety degrees about axis 624 from slot 652. This second slot is positioned such that when positioner 636 is pivoted about axis 624, panel 620 is retained in the position shown in FIG. 31. To reposition panel 620 about axis 624, panel 620 is lifted such that the slots of upper plate 646 disengage the tab 648. Panel 620 is pivoted about axis 624 until another slot engages tab 648.

Positioner 636 further includes a coupler 660 which is coupled to upper plate 646 and pivotable about pivot shaft 640. Thus, axis 632 is pivotable about axis 624. Coupler 660 supports a shaft 662 on which body 634 of panel 620 is supported. Another detent assembly 664 is coupled to both body 634 and shaft 662 and is configured to maintain body 634 in any of a number of positions about axis 632.

Figure 33:
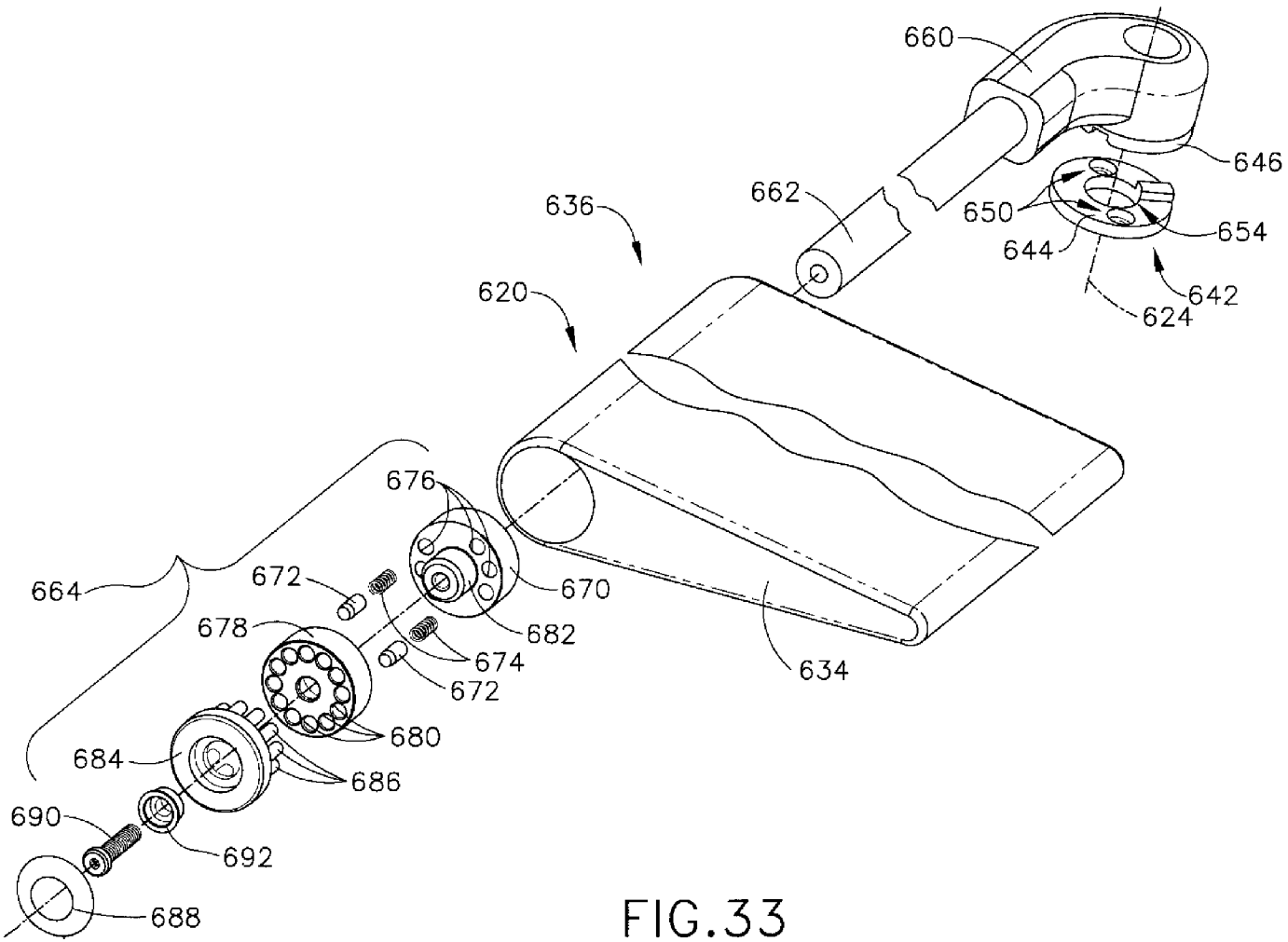
FIG. 33 is an exploded assembly view of the extender of FIGS. 31 and 32 the extender including an adjustment mechanism for adjusting the orientation of the extender and a pivot axis positioner for positioning the extender relative to the fixed portion of the end panel.
Figure 34:
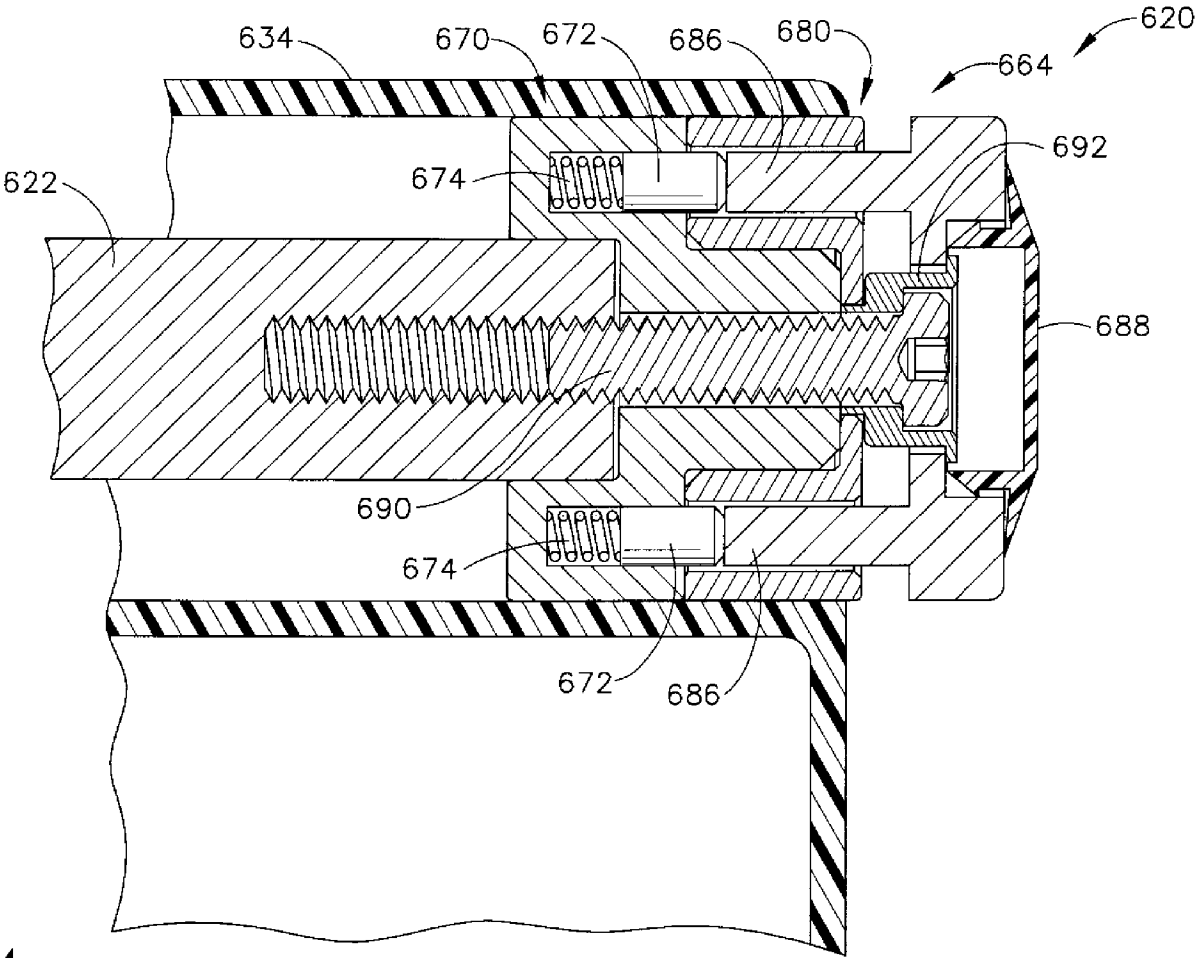
FIG. 34 is a cross-sectional view of the adjustment mechanism of FIGS. 30-33.

Detent assembly 664 utilizes an adjustable locking hub similar to part number CL-100-ALH-S from Carr Lane Manufacturing Company, St. Louis, Mo. Referring to FIG. 33, a base 670 is received in body 634. Two springs 674, 674 are received in two of a plurality of blind holes 676 formed in base 670. Two locating pins 672, 672 are engaged with springs 674, 674 and received in the two holes 676 such that the spring 674 urges the locating pin 672 away from the base 670. A locator 678 is engaged with the base 670 and locating pins 672. Locator 678 includes a plurality of locating through-holes 680 positioned equally about a perimeter of locator 678. Locator 678 is received on a hub 682 of base 670 to position locator 678 such that through-holes 680 are positioned in alignment with locating pins 672. An actuator 684 is engaged with locator 678 such that a plurality of actuation pins 686 are received in through-holes 680. A bushing 692 is interposed between actuator 684 and locator 678 such that a fastener 690 engages bushing 692 and fastener 690 is tightened to secure base 670 to shaft 662. Bushing 692 retains actuator 684 in engagement with locating pins 672. A cover 688 is positioned over locator 684. Locator 678 is secured to body 634 and base 670 is secured to shaft 662 such that movement between locator 678 and base 670 results in movement of body 634 relative to shaft 662.

In use, actuator 684 is depressed such that actuation pins 686 over come the bias of springs 674 to disengage locating pins 672 from locator 678. Body 634 is then rotated to a new position. In the new position, actuator 684 is release and body 634 is pivoted to allow one or both locating pins 672 to engage through-holes 680 in locator 678. Thus, body 634 is positionable to a plurality of positions about axis 632.

Figure 30:
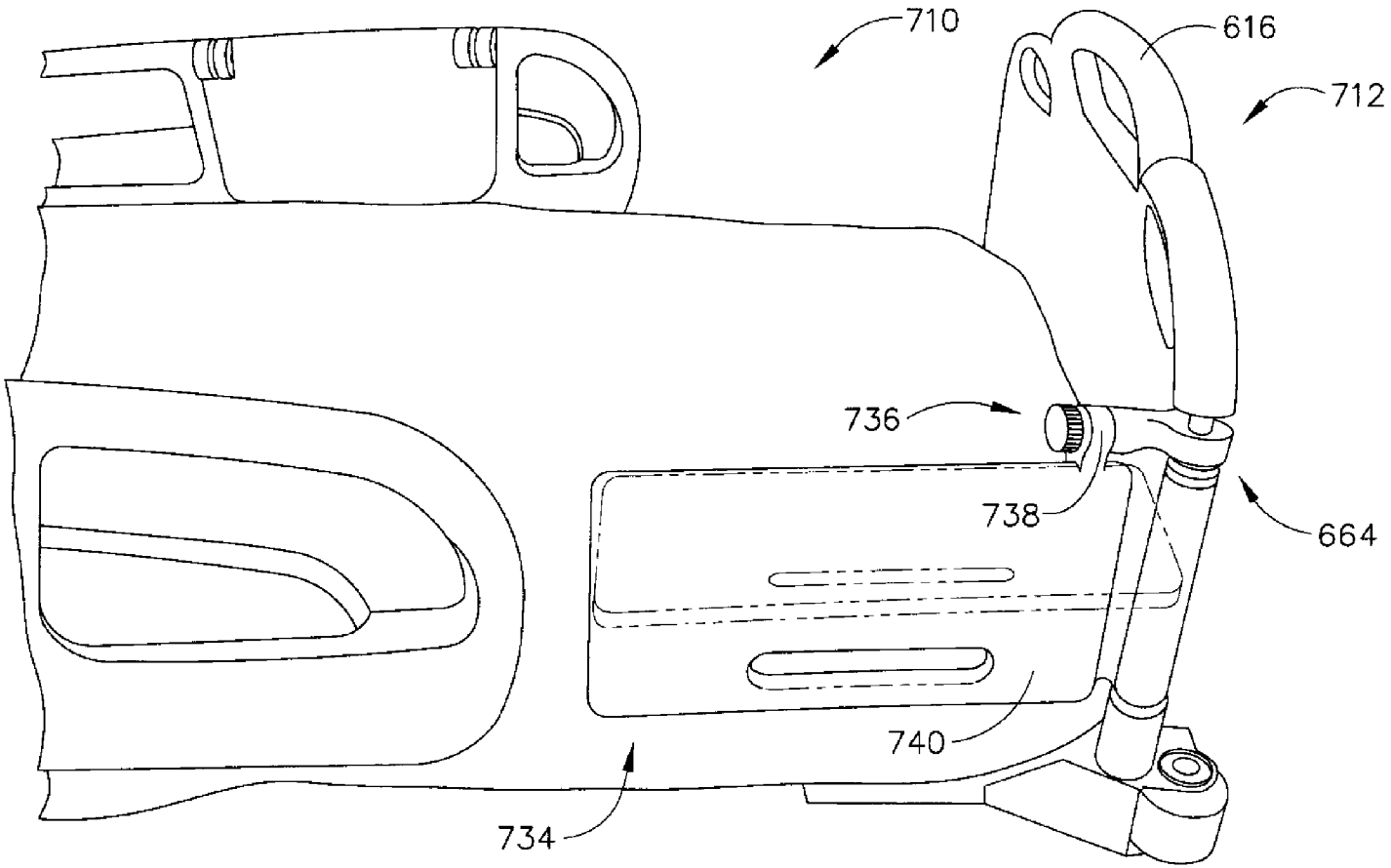
FIG. 30 is a perspective view of a portion of a patient-support apparatus including an end panel having a extender which moves from a stowed position to a plurality of use positions including a barrier position shown in solid in FIG. 30 and a shelf position shown in phantom in FIG. 30.

The discussion of the structure of panel 620 is applicable to the panel 618 with the only difference being that panel 618 is configured to function on the left side of the panel 612 and patient-support apparatus 610, whereas 618 is configured for the right side. Another embodiment of end panel 712 supported on a patient-support apparatus 710 shown in FIG. 30 is similar to end panel 612 in all respects with the exception that body 634 and positioner 636 are replaced with a body 734 and a positioner 736. Positioner 736 is similar to positioner 636 except that shaft 662 has been omitted and replaced with a shorter shaft (not shown). Body 734 includes a flange 738 which extends from a main portion 740. Flange 738 is coupled to detent assembly 664 and supported on the shorter shaft. In the illustrative embodiment of FIG. 30, the detent assembly 764 is positioned more closely to the main portion 616 of end panel 712 and therefore less likely to be inadvertently released by an occupant of the patient-support apparatus 710.

Figure 20:
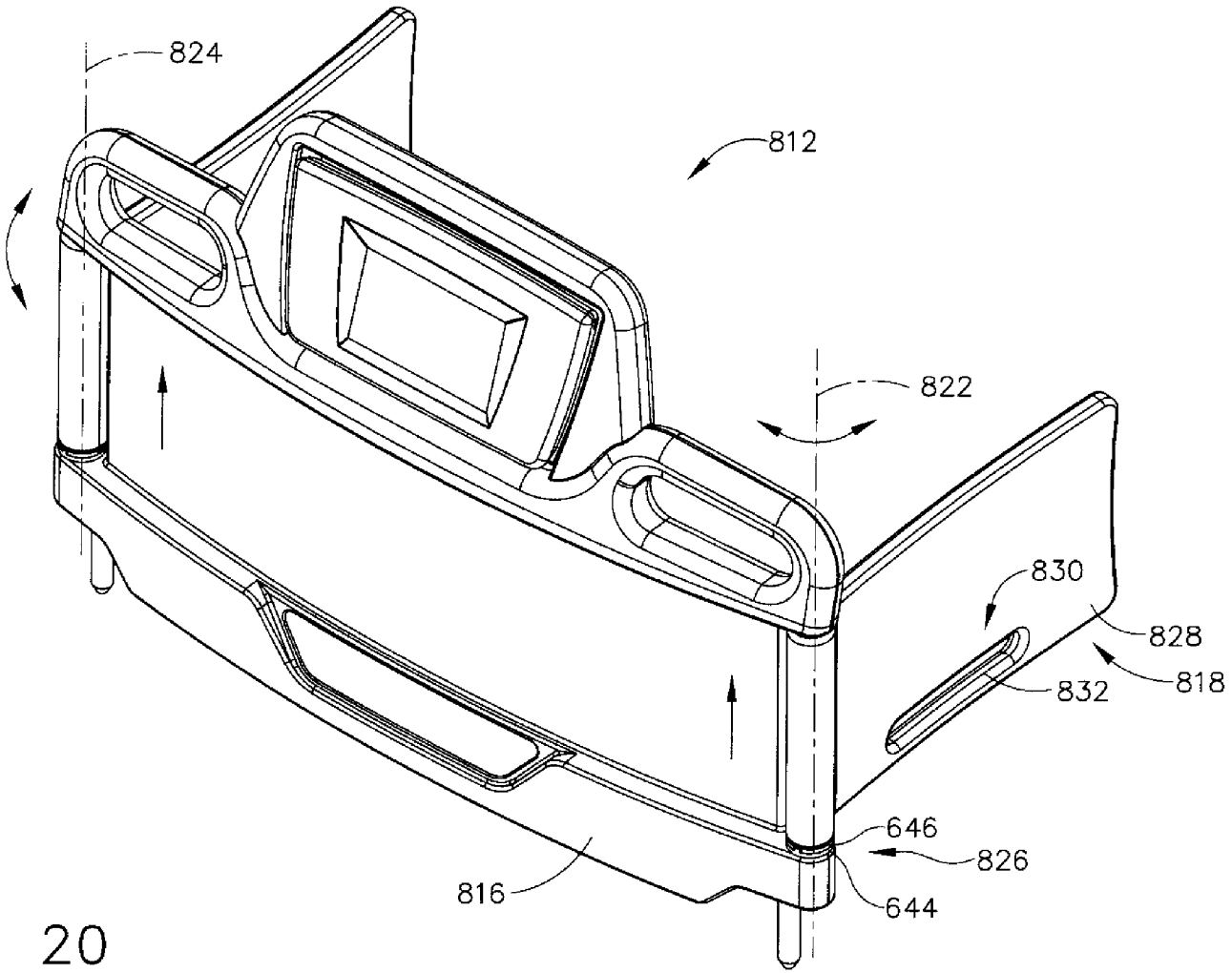
FIG. 20 is a perspective view of yet another embodiment of an end panel including a main portion and two moving portions pivotable relative to the main portion between a stowed position and a use position wherein the moving portions are positioned alongside a surface of the patient-support apparatus to form a barrier.

Yet another embodiment of end panel 812 includes two moving portions 818 and 820 as shown in FIG. 20. Moving portion 818 is pivotable about a generally vertical axis 822 and moving portion 820 is pivotable about a generally vertical axis 824. Each of the moving portions 818 and 820 include a detent assembly 826. Detent assembly 826 is similar to detent assembly 642 of the illustrative embodiments of FIGS. 31-33 and includes an upper plate 646 and a lower plate 644. With reference to moving portion 818 upper plate 646 is coupled to a body 828 of the moving portion 818. Lower plate 644 is coupled to a main portion 816 of end panel 812. Body 828 is movable along axis 822 when lifted to disengage a slot formed in upper plate 646 from the tab 648 to permit moving portion 818 to be pivoted about axis 822. Body 828 includes an aperture 830 formed therethrough and a handle 832. A user grips handle 832 or body 828 through aperture 830 to lift body 828 to disengage the detent assembly 826.

Figure 21:
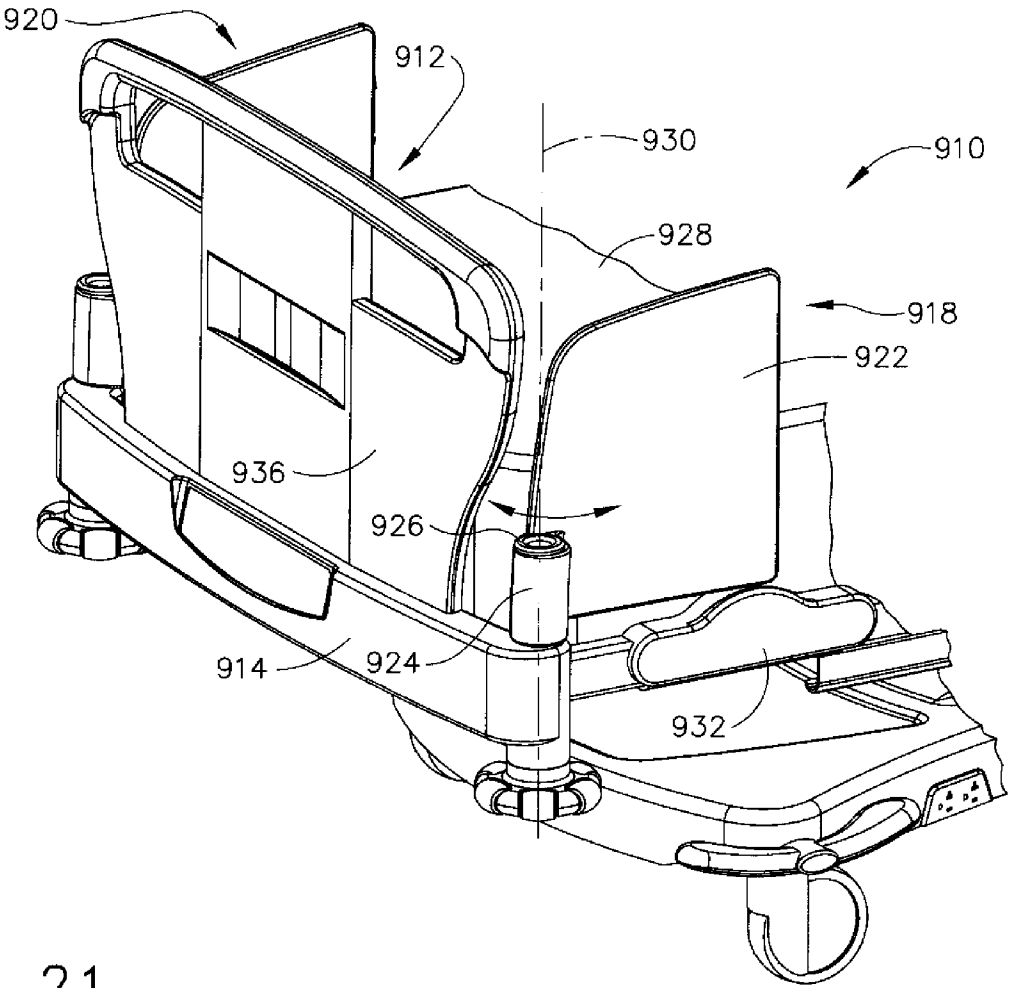
FIG. 21 is a perspective view of a portion of a patient-support apparatus including still yet another embodiment of an end panel having a main portion and two moving portions pivotable between a stowed position and a use position wherein the moving portions are positioned alongside a patient-support surface of the patient-support apparatus to form a barrier.
Figure 22:
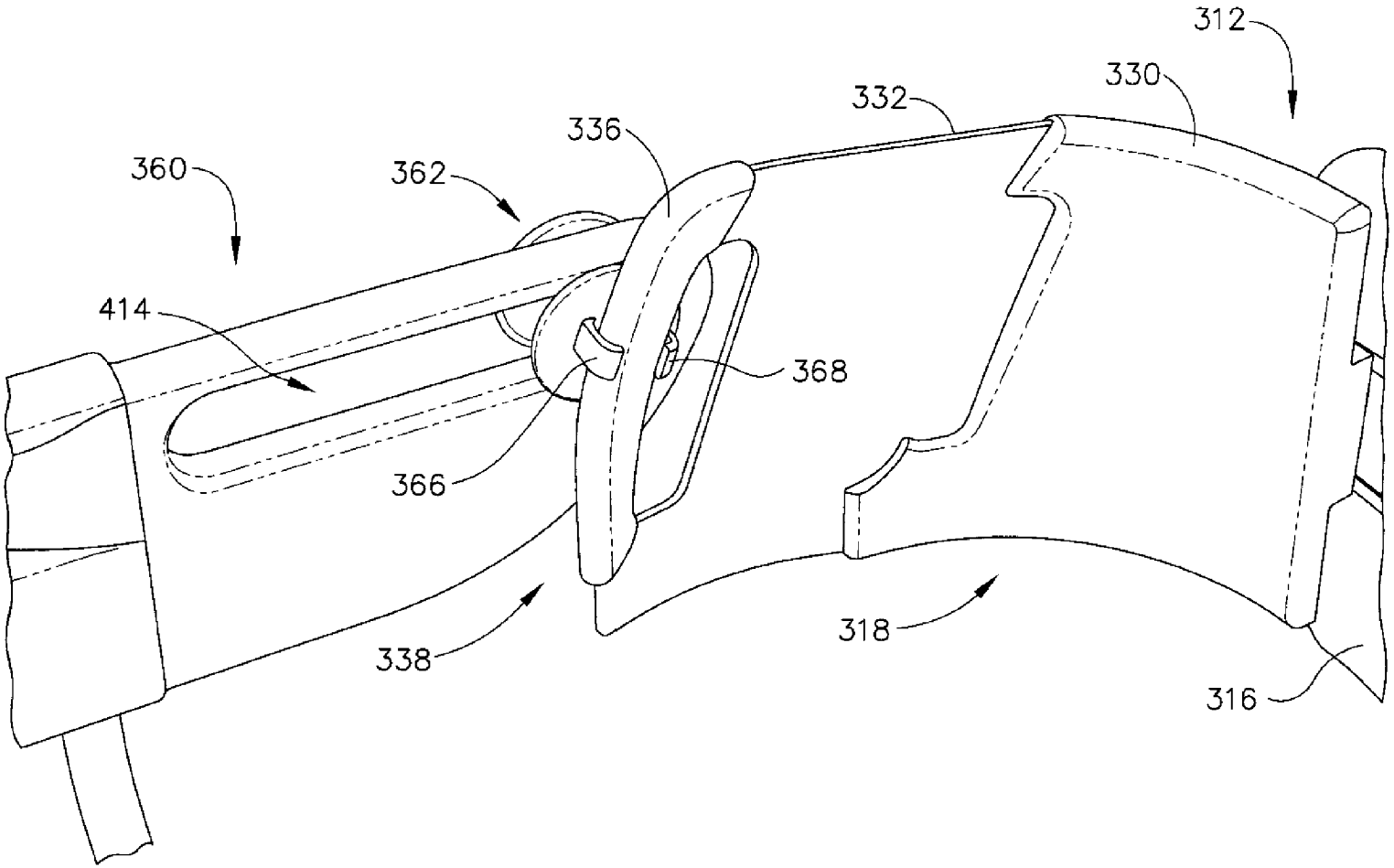
FIG. 22 is an enlarged view similar to FIG. 12.

In still another embodiment, a patient-support apparatus 910 includes a frame 914 and an end panel 912 mounted on frame 914 as shown in FIG. 21. In addition, two pivot panels 918 and 920 are supported on frame 914 and each are pivotable about a generally vertical axis. Referring now to pivot panel 918, a body 922 is coupled to a collar 924 which is positioned on a pivot shaft 926 coupled to frame 914 and which defines a pivot axis 930. Pivot panel 918 is pivotable about axis 930 and is configured to be pivoted to a position adjacent a mattress 928 supported on patient-support apparatus 910 as shown in FIG. 21. When in the position shown in FIG. 21, pivot panel 918 engages a retainer 932 which maintains pivot panel 918 adjacent mattress 928 to act as a barrier in the gap between end panel 912 and a siderail (not shown) of patient-support apparatus 910.

Collar 924 and shaft 926 are engaged such that some force is required to rotate collar 924 on shaft 926. Pivot panel 918 is pivotable between the position shown in FIG. 21 and a stowed position wherein a surface 934 of pivot panel 918 engages a surface 936 of end panel 912. The friction between collar 924 and shaft 926 maintain pivot panel 918 in the stowed position until sufficient force is applied by a user to reposition the pivot panel 918. Pivot panel 920 is similar to pivot panel 918 with the exception that pivot panel 920 is a right side version and pivot panel 918 is a left side version.

Although certain illustrative embodiments have been described in detail above, variations and modifications exist within the scope and spirit of this disclosure as described and as defined in the following claims.

The invention claimed is:

1. An end panel for a patient-support apparatus, the end panel comprising a main portion configured to engage a frame of the patient-support apparatus to form a boundary structure, the main portion comprising a generally vertical surface having a curvilinear profile when viewed along a generally vertical axis and a generally horizontal slot formed in the generally vertical surface, and an extender movable relative to the main portion to increase the size of the boundary structure, the extender comprising a generally vertical planar surface parallel to the generally vertical surface of the main portion and a guide engaged with the slot to support the extender relative to the main portion, the guide moveable in the generally horizontal slot along the vertical surface of the main portion between a first position and a second position as the extender moves relative to the main portion.

2. The end panel of claim 1, wherein movement of the extender relative to the main portion forms a boundary adjacent a longitudinal side of a mattress supported on the patient-support apparatus.

3. The end panel of claim 1, wherein the extender comprises a first portion movable relative to the main portion and a second portion which is engaged with the first portion and extendable relative thereto.

4. The end panel of claim 3, wherein the first portion comprises a first panel and a second panel, the first and second panels including tracks, wherein the second portion is received between the first and second panels, the second portion including guides received in the tracks to guide movement of the second portion relative to the first portion.

5. The end panel of claim 1, wherein the extender comprises a generally planar flange configured to extend between a frame of the patient-support apparatus and a mattress supported on the patient-support apparatus.

6. A patient-support apparatus comprising a frame including a first patient-support section and a second patient-support section movable relative to the first patient-support section to vary a size of a patient-support surface, a barrier structure comprising (i) a main portion configured to couple to the second patient-support section, and (ii) a moving portion engaged with the main portion and movable relative thereto, the moving portion configured to engage the first patient-support section to expand the barrier structure when the second patient-support section is moved relative to the first patient-support section, wherein the main portion comprises a generally vertical surface having a curvilinear profile when viewed along a generally vertical axis and a generally horizontal slot formed in the generally vertical surface, and the moving portion comprises an extender movable relative to the main portion to increase the size of the boundary structure, the extender comprising a generally vertical surface parallel to the generally vertical surface of the main portion and a guide engaged with the slot to support the extender relative to the main portion for movement relative thereto, and wherein the extender comprises a first portion movable relative to the main portion and a second portion which is engaged with the first portion and extendable relative thereto, and wherein the first portion further comprises an engagement pin and the first patient-support section further comprises a coupler configured to receive the engagement pin to couple the first portion of the extender to the first patient-support section.

7. The patient-support apparatus of claim 6, wherein the first portion of the extender comprises a first panel and a second panel, the first and second panels including tracks, wherein the second portion is received between the first and second panels, the second portion including guides received in the tracks to guide movement of the second portion relative to the first portion.

8. The patient-support apparatus of claim 6, wherein the patient-support apparatus further comprises a siderail spaced apart from the main portion of the barrier structure and a bracket releasably coupled to the siderail, the bracket including a clamp configured to receive the second portion of the extender to position the extender to occupy a gap between the siderail and the main portion of the barrier structure.

9. The patient-support apparatus of claim 8, wherein the clamp is spring biased and includes an actuator to overcome the spring bias to release the clamp.

10. The patient-support apparatus of claim 8, wherein the second portion comprises a handle and the bracket comprises a body and two arms sized to receive the handle.

11. The patient-support apparatus of claim 6, wherein the coupler includes a slide movable between a closed position and an open position.

12. The patient-support apparatus of claim 11, wherein the slide is spring biased to the closed position.

13. The patient-support apparatus of claim 6, wherein the second portion comprises a handle configured to extend the second portion relative to the first portion.

14. The patient-support apparatus of claim 6, wherein the second portion comprises a handle configured to move the first portion relative to the main portion and to extend the second portion relative to the first portion.

15. The patient-support apparatus of claim 6, wherein the extension and retraction of the second patient-support section relative to the first patient support section causes the first portion to move relative to the main portion.

16. A patient-support apparatus comprising a frame including a first patient-support section having a coupler and a second patient-support section movable relative to the first patient-support section to vary a size of a patient-support surface, a barrier structure comprising (i) a main portion configured to couple to the second patient-support section, and (ii) a moving portion engaged with the main portion and movable relative thereto, the moving portion configured to engage the first patient-support section to expand the barrier structure when the second patient-support section is moved relative to the first patient-support section, wherein the moving portion includes an extender having a first portion movable relative to the main portion and a second portion engaged with the first portion and extendable thereto, and wherein the first portion includes an engagement pin engaged with the coupler to couple the first portion of the extender to the first patient-support section.

17. The patient-support apparatus of claim 16, wherein the main portion comprises a generally vertical surface having a curvilinear profile when viewed along a generally vertical axis and a generally horizontal slot formed in the generally vertical surface, and the extender includes a generally vertical surface parallel to the generally vertical surface of the main portion and a guide engaged with the slot to support the extender relative to the main portion for movement relative thereto.

18. The patient-support apparatus of claim 17, wherein the first portion of the extender includes a first panel and a second panel, the first and second panels having tracks, wherein the second portion is received between the first and second panels, the second portion including guides received in the tracks to guide movement of the second portion relative to the first portion.

19. The patient-support apparatus of 16, wherein the patient-support apparatus further comprises a siderail spaced apart from the main portion of the barrier structure and a bracket releasably coupled to the siderail, the bracket including a clamp configured to receive the second portion of the extender to position the extender to occupy a gap between the siderail and the main portion of the barrier structure.

20. The patient-support apparatus of claim 16, wherein the coupler includes a slide movable between a closed position and an open position.

21. The patient-support apparatus of claim 20, wherein the slide is spring biased to the closed position.

22. The patient-support apparatus of claim 16, wherein the second portion comprises a handle configured to extend the second portion relative to the first portion.

23. The patient-support apparatus of claim 16, wherein the second portion comprises a handle configured to move the first portion relative to the main portion and to extend the second portion relative to the first portion.

24. The patient-support apparatus of claim 16, wherein the extension and retraction of the second patient-support section relative to the first patient support section causes the first portion to move relative to the main portion.

25. The patient-support apparatus of claim 16, wherein the second portion comprises a handle and the bracket comprises a body and two arms sized to receive the handle.

* * * * *